US005654516A

United States Patent [19]

Tashiro et al.

[11] Patent Number: 5,654,516

[45] Date of Patent: Aug. 5, 1997

[54] KARAOKE SYSTEM HAVING A PLAYBACK SOURCE WITH PRE-STORED DATA AND A MUSIC SYNTHESIZING SOURCE WITH REWRITEABLE DATA

[75] Inventors: Masashi Tashiro; Youji Semba, both of Hamamatsu, Japan

[73] Assignee: Yamaha Corporation, Hamamatsu, Japan

[21] Appl. No.: 709,641

[22] Filed: Sep. 9, 1996

Related U.S. Application Data

[63] Continuation of Ser. No. 209,516, Mar. 10, 1994, abandoned

[30] Foreign Application Priority Data

Nov. 3, 1993 [JP] Japan ..... 5-077637

[51] Int. Cl.[6] ..... G10H 7/00

[52] U.S. Cl. ..... 84/601; 84/615; 84/645

[58] Field of Search ..... 84/600, 601, 609, 84/610, 634, 645, 615

[56] References Cited

U.S. PATENT DOCUMENTS

| | | | |
|---|---|---|---|
| 5,046,004 | 9/1991 | Tsumura et al. | 84/601 X |
| 5,194,682 | 3/1993 | Okamura et al. | 84/645 X |
| 5,235,124 | 8/1993 | Okamura et al. . | |
| 5,243,123 | 9/1993 | Chaya . | |
| 5,247,126 | 9/1993 | Okamura et al. . | |
| 5,250,745 | 10/1993 | Tsumura . | |
| 5,252,775 | 10/1993 | Urano | 84/645 |
| 5,286,907 | 2/1994 | Okamura et al. . | |
| 5,294,746 | 3/1994 | Tsumura et al. . | |
| 5,300,725 | 4/1994 | Manabe | 84/645 X |
| 5,410,097 | 4/1995 | Kato et al. . | |
| 5,513,352 | 4/1996 | Tozuka | 84/601 X |

FOREIGN PATENT DOCUMENTS

| | | |
|---|---|---|
| 0372678 | 6/1990 | European Pat. Off. . |
| 0427447 | 5/1991 | European Pat. Off. . |
| 0457980 | 11/1991 | European Pat. Off. . |
| 207083 | 12/1983 | Japan . |
| 321100 | 4/1992 | Japan . |
| 128796 | 4/1992 | Japan . |

OTHER PUBLICATIONS

European Search Report, May 3, 1994, Appl. No. GB 9404818.8.

*Primary Examiner*—William M. Shoop, Jr.
*Assistant Examiner*—Jeffrey W. Donels
*Attorney, Agent, or Firm*—Loeb & Loeb LLP

[57] ABSTRACT

A karaoke system sounds a karaoke song designated according to a request command. The system includes a record unit defining a closed data source for readably recording a karaoke song, and a playback unit for reading the record unit to reproduce an audio signal representative of the karaoke song such that the record unit and the playback unit compose a playback karaoke equipment. The system further includes a supply unit defining an open data source for accessibly supplying a song data prescriptive of a karaoke song, and a synthetic unit for processing the supplied song data to synthetic size an audio signal representative of the karaoke song such that the supply unit and the synthetic unit compose a synthetic karaoke equipment. A total control unit is provided for selectively activating either of the playback and synthetic karaoke equipments according to a request command to achieve efficient use of the closed and open data sources. A sound unit receives the audio signal from the activated one of the playback and synthetic karaoke equipments to thereby readily sound a designated karaoke song.

19 Claims, 23 Drawing Sheets

| Arrange code | word | Accompaniment | Picture |
|---|---|---|---|
| NO.1 | 1 | 1 | 1 |
| NO.2 | 2 | 1 | 2 |
| NO.3 | 3 | 2 | 2 |
| | | | |

KARAOKE SYSTEM HAVING A PLAYBACK SOURCE WITH PRE-STORED DATA AND A MUSIC SYNTHESIZING SOURCE WITH REWRITEABLE DATA

This is a continuation of application Ser. No. 08/209,516, filed Mar. 10, 1994, now abandoned.

BACKGROUND OF THE INVENTION

The present invention relates to a total karaoke system composed of a playback karaoke equipment and a synthetic karaoke equipment.

A karaoke apparatus is constructed such as to produce an instrumental accompaniment part of a requested song, which is concurrently mixed with a live vocal part of the same song picked up by a microphone. The karaoke apparatus becomes popular, and is installed not only in a bar and a club, but also in a specialized rental room called "karaoke box" and a vehicle such as a tourist bus. The conventional karaoke apparatus is normally a playback type or a musical tone reproduction type composed of a record unit for recording analog or digital audio information (i.e., music accompaniment data) and associated video information of karaoke songs, an audio unit for reproducing the karaoke song and mixing a singing voice therewith, a video unit for displaying background pictures and word characters along with the reproduction of the karaoke song, and a control unit for controlling these of the record, audio and video units. Recently, another karaoke apparatus of a synthetic type or a musical tone generating type is developed, which contains a tone generator for synthesizing musical tones according to a song data prescriptive of the karaoke song (i.e., musical performance designation data). Generally, the synthetic karaoke apparatus is connected through a communication network to a host station for retrieving therefrom the song data.

The playback karaoke apparatus has the record unit which is a closed or isolated data source, hence the playback karaoke apparatus cannot respond to a request for a non-entry karaoke song which is not stored in the record unit. On the other hand, the synthetic karaoke apparatus can access a database of the host station to freely retrieve therefrom a desired song data in response to a singer's request. An extreme type of the synthetic karaoke apparatus is solely dependent on the data telecommunication such that all the requested song data are supplied from the host station without exception. In order to save data communication cost and time required for repeated access to the host station upon every request, a semi-self-support type of the synthetic karaoke apparatus has a storage defining an open data source for stocking the song data supplied from the host station for re-use.

SUMMARY OF THE INVENTION

In introduction of the synthetic karaoke apparatus of either type into the market, the complete replacement of the old playback karaoke apparatus by the new synthetic karaoke apparatus may result in disposal of the old one, which may cause economic disadvantages to both of users and makers of the new type. In order to solve such a problem, an object of the present invention is to integrate the playback and synthetic karaoke apparatuses with each other to constitute a total karaoke system which allows efficient use of components of the playback karaoke apparatus, and smooth introduction of the synthetic karaoke apparatus. Another object of the present invention is to achieve efficient use of both the closed data source provided for the playback karaoke apparatus and the open data source provided for the synthetic karaoke apparatus in the total karaoke system. A further object of the present invention is to achieve easy and timely maintenance of the open data source in the total karaoke system.

In a first aspect of the invention, a karaoke system for sounding a karaoke song according to a request command, the request command corresponding to a karaoke song desired by a singer, comprises music playback means for pre-storing music accompaniment data as a closed data source, and for reading out the pre-stored music accompaniment data to reproduce an audio signal corresponding to the music accompaniment data, music systhesizing means for storing music performance designation data as an open data source, and for synthesizing an audio signal in accordance with the music performance designation data, control means for receiving the request command, and for selecting either of the music playback means and the music synthesizing means according to the request command, and for controlling a selected one of the music playback means and the music systhesizing means to output an audio signal, and sound means receptive of the audio signal outputted by the selected one of the music playback means and the music synthesizing means, and for sounding a desired karaoke song corresponding to the received audio signal.

In a second aspect of the invention, a karaoke system is comprised of a host station and a remote branch for sounding a designated karaoke song according to a request command. The host station has an original database communicable with the remote branch to transmit thereto a song data prescriptive of a karaoke song in response to a request command. The remote branch includes storage means for stocking the transmitted song data to form a stock data file, record means independent from the database and the stock data file for recording a karaoke song to form a separate data source, control means responsive to a request command for firstly accessing the separate data source, then secondly accessing the stock data file if the designated karaoke song is not found in the separate data source, and thirdly accessing the original database if the designated karaoke song is not found in the stock data file, playback means connectable to the accessed separate data source for reproducing the designated karaoke song, and synthetic means receptive of the song data from either of the accessed stock data file and the original database for processing the song data to synthesize the designated karaoke song.

In a third aspect of the invention, a karaoke system for sounding a designated karaoke song according to a request command comprises storage means installed at a given spot to provide an open data source for stocking a song data prescriptive of a karaoke song, a portable loading implement for storing a package of the song data, and being carried to the given spot to couple with the storage means for loading thereinto the package of the song data to thereby fill the open data source, synthetic means for retrieving a song data from the open data source according to a request command and for processing the retrieved song data to synthesize an audio signal representative of the designated karaoke song, and sound means receptive of the audio signal to sound the designated karaoke song.

According to the first aspect of the invention, the music playback means and the music synthesizing means are integrated with each other by means of the control means to constitute the total karaoke system. According to the second aspect of the invention, the open data source of the synthetic karaoke equipment is accessed only when the requested karaoke song is not available in the closed data source of the playback karaoke equipment. Further, in such a case, the data file stocked in the storage means of the synthetic karaoke equipment is given a priority relative to the database of the host station to avoid repeated accesses thereto. According to the third aspect of the invention, the separate portable loading implement is utilized to load a package of the song data into the open data source in easy and timely manner even though the telecommunication data supply is not available.

DETAILED DESCRIPTION OF THE INVENTION

Figure 1:
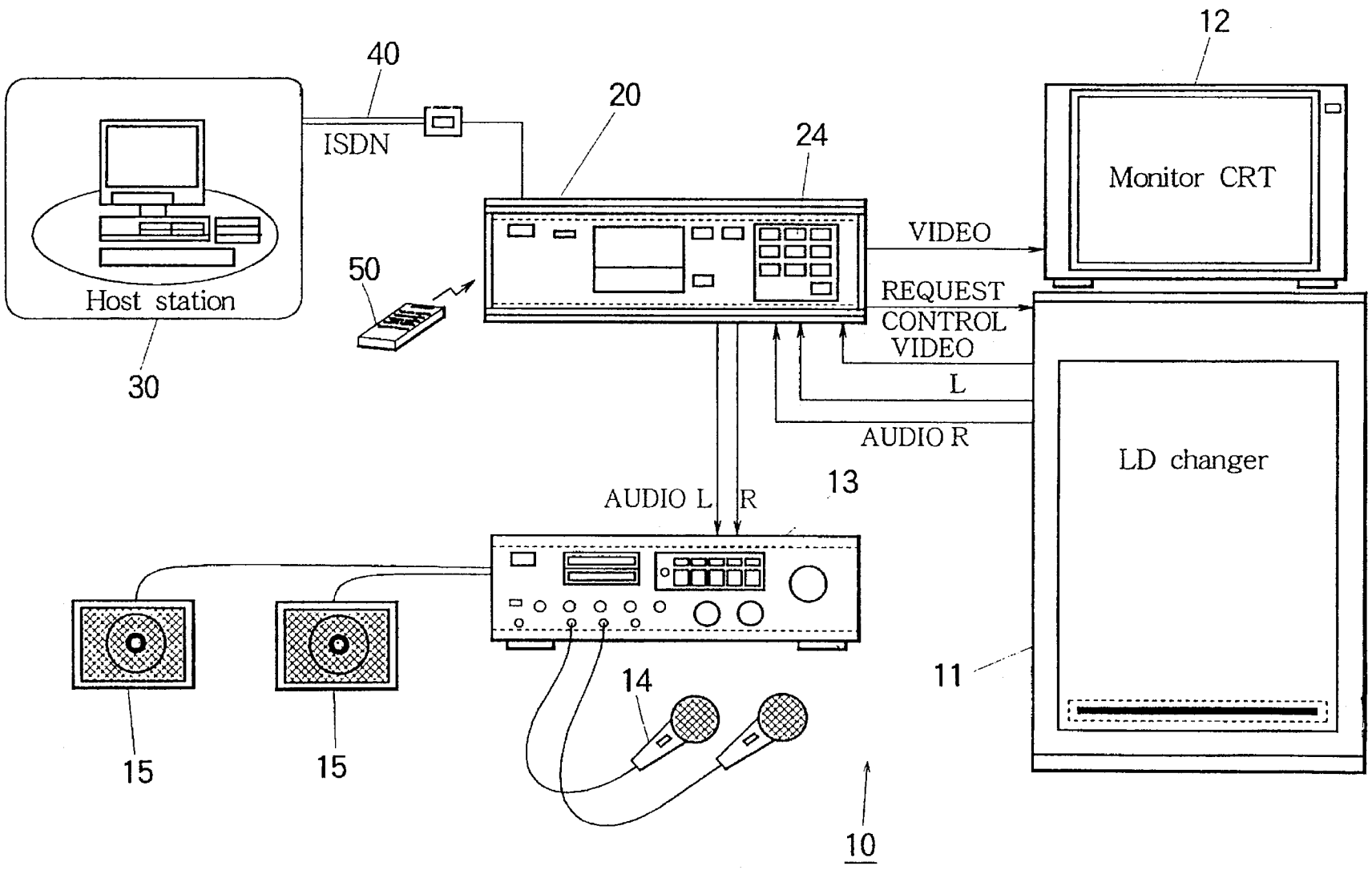
FIG. 1 is an overall system diagram showing an inventive total karaoke system.

Hereinafter, embodiments of the invention will be described in conjunction with the drawings. FIG. 1 shows an overall construction of a total karaoke system according to the present invention. The system includes a Laser Disc (LD) changer 11, a display in the form of a monitor CRT 12, a mixing amplifier 13, a microphone 14, and a pair of loudspeakers 15, those of which are connected altogether to constitute an ordinary karaoke equipment 10 of the musical tone reproducing type or the playback type. The inventive system further includes a total control device 20 which contains a tone generating processor and which is connected to those of the monitor CRT 12 and the mixing amplifier 13 to functionally constitute another karaoke equipment of the musical tone generating type or the synthetic type. This total control device 20 functions as a total system commander connected to a part of the playback type karaoke equipment 10 so as to build and control the total karaoke system which is an integration of the playback karaoke and the synthetic karaoke. A remote host station 30 is connected to the total control device 20 through a fast digital communication network such as Integrated Services Digital Network (ISDN) to transmit thereto a requested song data. A remote controller 50 is provided to input a command such as a song request into the total karaoke system.

The playback karaoke equipment 10 is a self-supporting type such that the LD changer 11 contains a great number of Laser Discs (LDs) as a closed data source. The Laser Disc records a number of karaoke songs and associated words and background pictures. The LD changer 11 is controlled by the request command to access and select the Laser Discs to output an audio signal AUDIO representative of the requested karaoke song to the mixing amplifier 13 as well as to output a video signal VIDEO representative of the associated words and pictures. The mixing amplifier 13 mixes a live voice of a singer picked up by the microphone 14, with a karaoke accompaniment of the requested song. The loudspeaker 15 acoustically transmits the mixed sound of the voice and the accompaniment. Concurrently, the monitor CRT 12 displays the song words and the background picture associated to the requested karaoke song to assist in the vocal performance of the singer.

Figure 2:
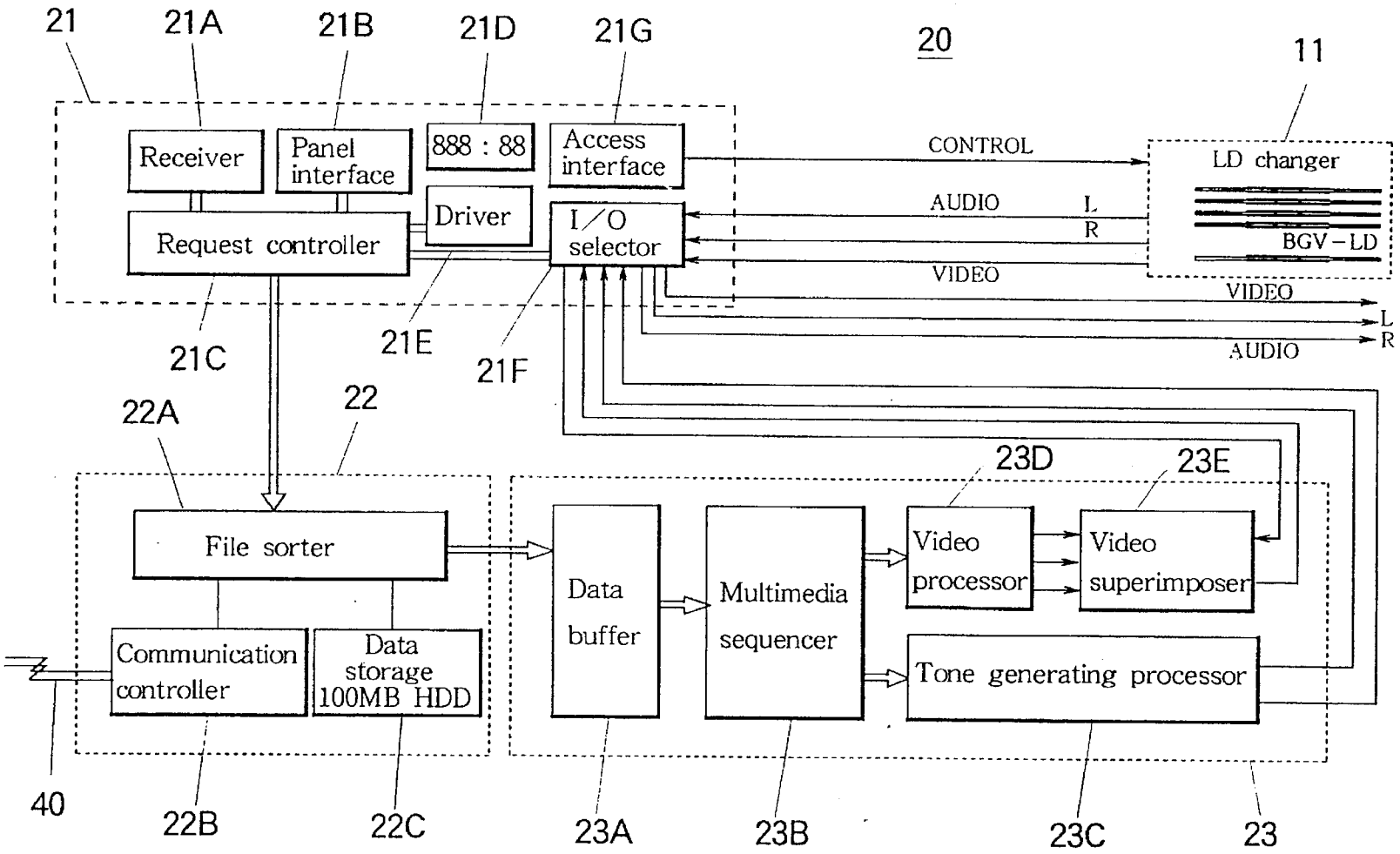
FIG. 2 is a block diagram of a total control device incorporated in the inventive total karaoke system.

FIG. 2 is a block diagram showing a detailed internal construction of the total control device 20. The total control device 20 is generally divided into a command block 21 for integrally controlling the playback and synthetic karaoke equipments, a data file block 22 for stocking song data used in the synthetic karaoke, and an acoustic/graphic block 23 having various functions. First, the command block 21 is comprised of a receiver 21A, a panel interface 21B, a request controller 21C, an indicator 21D, a driver 21E, an I/O selector 21F and an access interface 21G. The receiver 21A receives a command from the remote controller 50. The panel interface 21B admits another command inputted from a switch panel 24 (FIG. 1) installed in the front face of the total control device 20. the request controller 21C operates in response to a command of song request from either of the receiver 21A and the panel interface 21B so as to organize a plurality of song requests to effect selection and/or reservation of the requested karaoke songs. The indicator 21D is driven by the driver 21E to indicate item codes the selected or reserved songs. The I/O selector 21F selects inputs and outputs of the audio and video signals.

The data file block 22 is comprised of a file sorter 22A, a communication controller 22B and a data storage 22C. The file sorter 22A receives the selected or reserved item codes of the karaoke songs from the request controller 21C. The communication controller 22B communicates to the host station 30 through the ISDN network 40. The data storage 22C stocks the song data received from the host station through the ISDN network 40 to form a data file as an open data source. In operation, when the file sorter 22A receives the select or reserve command from the request controller 21C, the file sorter 22A initially accesses the data storage 22C to search if the song data of the requested karaoke song is stored. If stored, the searched song data is read out. On the other hand, if not stored, the communication controller 22B is activated to admit a requested song data from a database of the host station 30. The data storage **22*c*** is comprised of, for example, a hard disc driver (HDD) having a capacity of 100 MB (megabyte) such that the HDD can stock one thousand songs provided that each karaoke song is prescribed by 10 KB (kilobyte) of song data in average.

The acoustic/graphic block 23 is comprised of a data buffer 23A, a multimedia sequencer 23B, a tone generating processor 23C, a video processor 23D and a video superimposer 23E. The data buffer 23A temporarily holds the song data supplied from the file sorter 22A. The multimedia sequencer 23B synchronously controls various events including musical tones, pictures and additional effects according to event information contained in the song data. The tone generating processor 23C processes the song data to synthesize the musical tone of the karaoke song under the control by the sequencer 23B. The video processor 23D generates the background picture, the characters of the song words and else. The video superimposer 23E superimposes the graphic outputs of the video processor 23D with another picture such as a background motion picture which is recorded in a background video LD (BGV-LD) loaded in the LD changer 11.

The I/O selector 21F of the command block 21 coordinates the audio part of the karaoke performance such as to select either of the playback audio output from the LD changer 11 and the synthesized audio output from the tone generating processor 23C to feed the mixing amplifier 13. Further, the I/O selector 21F coordinates the video part of the karaoke performance such as to select either of the video output reproduced from the LD changer 11 and the other video output generated from the video superimposer 23E to feed the monitor CRT 12. If the LD changer 11 is disconnected from the I/O selector 21F, the synthetic karaoke equipment and the playback karaoke equipment are functionally independent from each other. The synthetic and playback karaoke equipments are integrated with each other by means of the I/O selector 21F and the access interface 21G, which are provided in the total control device 20.

In the total karaoke system as shown in FIGS. 1 and 2, the command block 21 operates in response to a song request from the remote controller 50 or else to initially check as to if the requested song is recorded in the closed and separate data source of the LD changer 11. Namely, the first priority is given to the playback karaoke equipment 10 for efficient use of the audio and video source recorded in the LD changer 11. If the LD changer 11 stores the requested karaoke song, its audio an video outputs are utilized to effect the karaoke performance. On the other hand, if the requested karaoke song is not found in the LD changer 11, the command block 21 passes a item code of the requested karaoke song to the file sorter 22A so as to utilize song data of the synthetic karaoke equipment. In such a case, the database of the host station 30 is not accessed immediately, but the internal data storage 22C is accessed precedingly to check as to if the requested song data is stocked. If stocked, the requested song data is retrieved from the data storage 22C for the musical tone synthesis. Namely, the second priority is given to the open data file of the data storage 22C. Further, if the requested song is not found in the data storage 22C, the host station 30 is called to transmit therefrom the requested song data through the ISDN network 40. Namely, the third priority is given to the original database of the host station. In case that the synthetic karaoke equipment is not provided with the data storage 22C, the song data retrieval from the host station is given the second priority.

Figure 3:
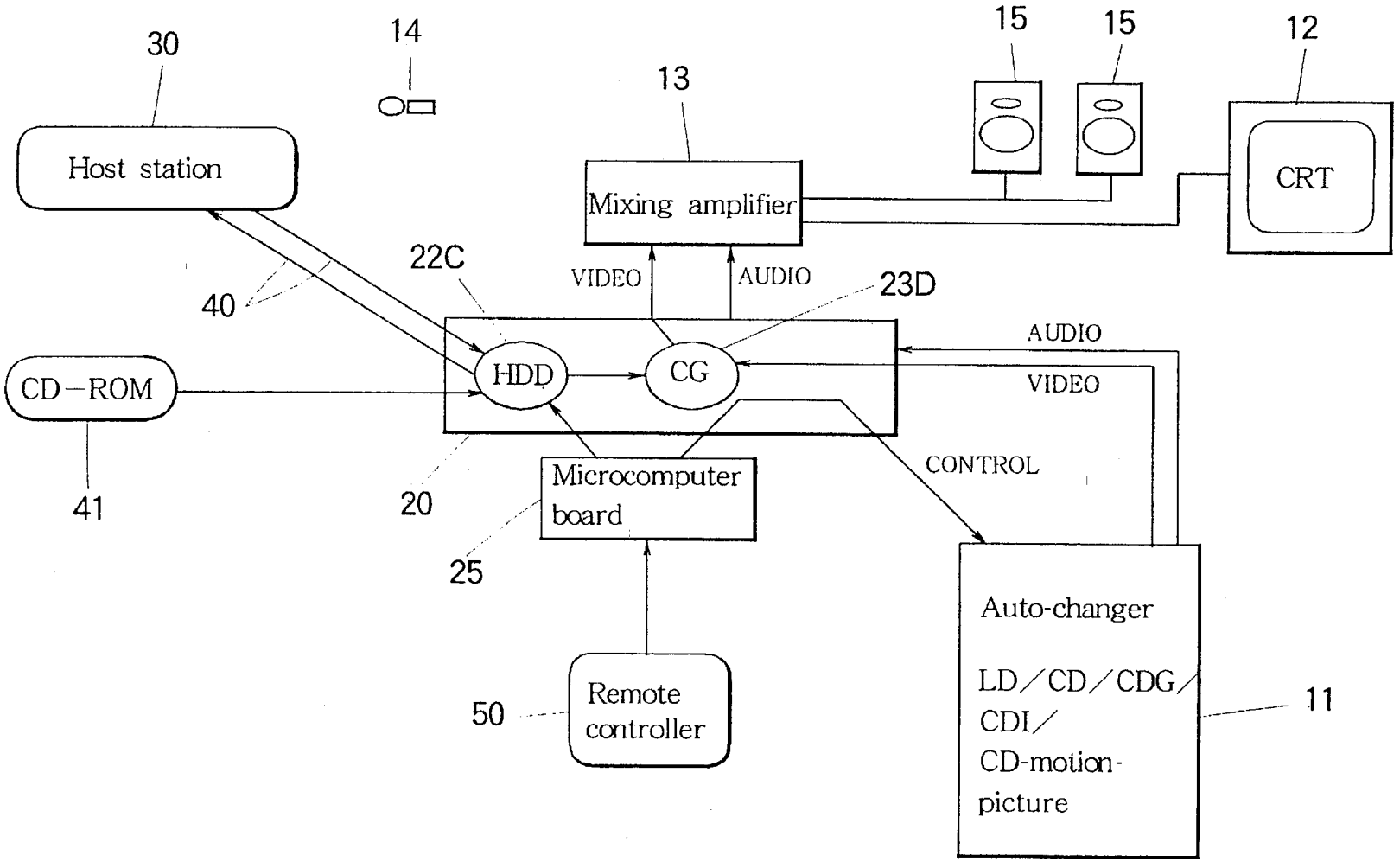
FIG. 3 is a functional block diagram of the FIG. 1 system.

FIG. 3 is a schematic diagram showing a functional connection among significant components of the total karaoke system illustrated in FIGS. 1 and 2. The inventive total control device 20 contains a microcomputer board 25 which has a coordinating function to integrally control the playback and synthetic karaoke equipments. This microcomputer board 25 operates according to the designation of the song item code from the remote controller 50 to search index data recorded in the data storage (HDD) 22C to judge as to which of the synthetic and playback karaoke equipments should be activated. The synthetic karaoke equipment uses the song data originally transmitted through the communication network 40, or optionally uses a song data recorded in a CD-ROM 41. On the other hand, the playback karaoke equipment uses audio and video data sources such as Laser Disc (LD), Compact Disc (CD), Compact Disc Graphics (CDG), Compact Disc Interactive (CDI) and CD-motion-picture (CDV or Video CD), which are installed in the auto-changer 11. In this embodiment, the data storage (HDD) 22C and the video processor (computer graphics, CG) 23D are standard components of the synthetic karaoke subsystem, while the microcomputer board 25 is a custom component which integrates remaining control functions. This microcomputer board 25 is a cassette type selectively inserted into the body of the total control device 20 so as to match with a model type of the total karaoke system. Alternatively, the microcomputer board 25 may be built in as the standard component except for a program ROM (not shown in the figure) which is selectively mounted so as to match with a model type of the total karaoke system.

Figure 4:
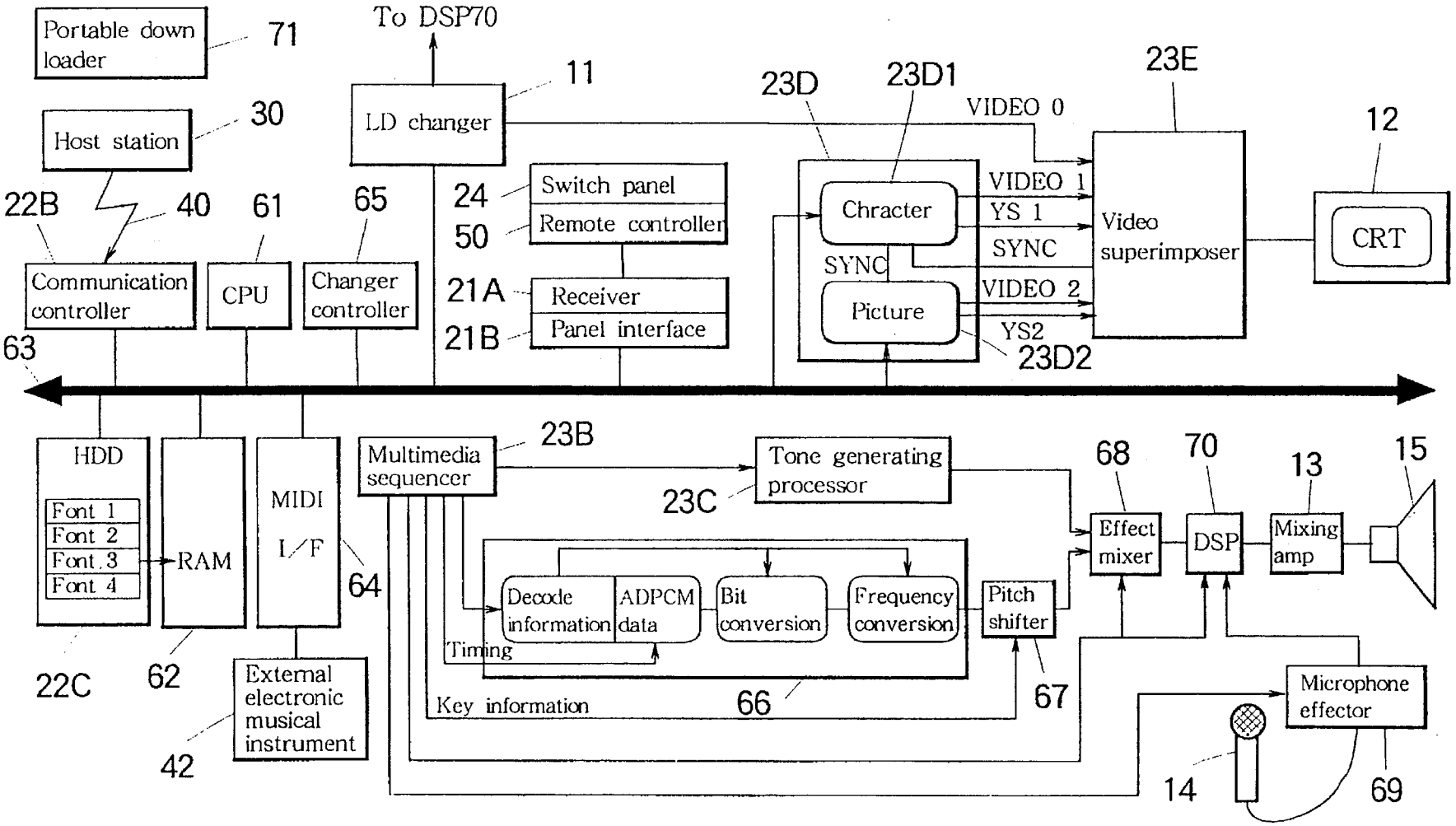
FIG. 4 is a detailed structural diagram of the FIG. 1 system.

FIG. 4 shows a detailed construction of the inventive total karaoke system. The disclosed embodiment contains additional components not explicitly illustrated in FIGS. 1–3. For example, a central processing unit (CPU) 61 is provided to undertake overall control of the karaoke system according to a program ROM installed in the multimedia sequencer 23B. A random access memory (RAM) 62 provides a working area used when the CPU 61 undertakes the overall control of the karaoke system. A data and address bus line 63 connects the various components altogether to constitute the total karaoke system. A MIDI interface 64 is provided to connect to an external electronic musical instrument 42. The MIDI data contains, for example, a duration of musical notes, a time length between adjacent musical notes and a tempo of a piece of music. A changer controller 65 controls the LD changer 11. The changer controller 65 can be selected according to a model type of the LD changer 11.

An ADPCM decoder 66 is provided to undertake bit-conversion and frequency-conversion to expand an adoptive delta pulse code modulation (ADPCM) data containing compacted audio signals fed from the multimedia sequencer 23B. A pitch shifter 67 is connected to the ADPCM decoder 66 for controlling the tone pitch of the decoded audio signal according to key information provided from the multimedia sequencer 23B. An effect mixer 68 receives the outputs of the pitch shifter 67 and the tone generating processor 23C. The tone generating processor 23C functions as a music synthesizer driven by a song data to synthesize an audio signal of the karaoke song. The tone generating processor 23C is comprised of a tone generating unit for synthesizing the musical tone based on the MIDI data or else and a controlling unit. A microphone effector 69 imparts a sound effect such as an echo, an excitement and else to an output of the microphone 14. A digital sound field processor (DSP) 70 is provided to impart a sound field effect to the output of the microphone effector 69 and the audio output of the LD changer 11.

On the other hand, the video processor 23D processes character information representative of words and else associated to the performed song, and background picture information representative of still and motion pictures so as to generate a video signal for display. In this embodiment, the video processor 23D is divided into two units 23D1 and 23D2. The one video processor unit 23D1 generates the song word characters to output a video signal VIDEO 1, and the other video processor unit 23D2 generates the background pictures to output the video signal VIDEO 2. The LD changer 11 is operated to reproduce the karaoke song recorded in the Laser Disc in the playback karaoke mode, or otherwise to reproduce image information alone for use in the synthetic karaoke mode. More particularly in the synthetic karaoke mode, the LD changer 11 is operated in synchronization with the karaoke accompaniment synthesized by the tone generating processor 23C to output a video signal VIDEO 0 representative of a still picture recorded in a given frame of a given Laser Disc, or representative of a motion picture which starts from a given frame. The video superimposer 23E superimposes these video signals VIDEO 0, VIDEO 1 and VIDEO 2 with each other to form a composite picture.

Further, a down loader 71 of the portable type is utilized to load a package of the song data into the storage (HDD) 22C without using the ISDN network 40. For example, when the total karaoke system is installed at a given user spot, a supplyer brings the portable down loader 71 to the user spot to load the package of song data at once. By such a volume loading, the user can save a long time communication with the host station 30 through the ISDN network 40, which would be needed for transfer of the great volume of the song data.

Hereinafter, detailed description will be given to various aspects of the operation of the inventive total karaoke system in conjunction with the drawings.

Playback/Synthesis control

When the remote controller 50 or the switch panel 24 is actuated to designate a karaoke song to be performed, the CPU 61 refers to an index table stored in the data storage 22C to check as to if the designated song is recorded in the LDs of the auto-changer 11 which is given the first priority. If recorded, the designated song is reproduced from the LD in the playback mode. The auto-changer 11 outputs the audio signal which is transmitted to the loudspeaker 15 through the DSP 70, and concurrently outputs the video signal VIDEO 0 which is transmitted to the monitor CRT 12 through a selector section of the video superimposer 23E. On the other hand, the live voice of the singer is converted by the microphone 14 into an electric signal which is fed to the DSP 70 through the microphone effector 64. The mixing amplifier 13 mixes the accompaniment part and the vocal part with each other so that the loudspeaker 15 produces the mixed audio output.

If the designated song is not recorded in the LD changer 11, the CPU 61 searches the song data stocked in the HDD storage 22C which is given the second priority. If the designated song is stocked in the data storage 22C, the song data is retrieved and loaded into the RAM 62. the tone generating processor 23C operates according to the song data to synthesize the musical tones to effect the karaoke performance. Such a synthesis of the musical tone is carried out under the control by the multimedia sequencer 23B. With regard to the audio part, the tone generating processor 23C successively generates the musical tone signal according to the digital song data read out from the RAM 62. The musical tone signal is acoustically reproduced by the loudspeaker 15 through the effect mixer 68, the DSP 70 and the mixing amplifier 13. With regard to the video part, the video processor units 23D1 and 23D2 produce the word characters and the background pictures, respectively, according to graphic information contained in the song data under the control by the multimedia sequencer 23B in synchronization with progression of the song. The generated word characters and background pictures are visually displayed by the monitor CRT 12 through the video superimposer 23E. Additionally, another background picture reproduced from the LD charger 11 may be also superposed to the background picture and the word characters by the video superimposer 23E. The word characters are variably displayed by the monitor CRT 12 such that a color of the displayed words is sequentially changed in synchronization with progression of the song so as to teach the player vocal timings. Accordingly, the player can sing a song while handling the microphone 14 and following the word characters displayed on the monitor CRT 12.

If the designated song data is not stocked in the HDD storage 22C, the CPU 61 activates the communication controller 22B to take the designated song data from the host station 30 on line, which is given the third priority. Namely, the host station 30 is called through the ISDN network 40. When the host station 30 responds to the calling, the song item code is sent to request the designated song data. The taken song data is stocked in the HDD storage 22C for re-use.

Data transfer scheme from the host station

Figure 5:
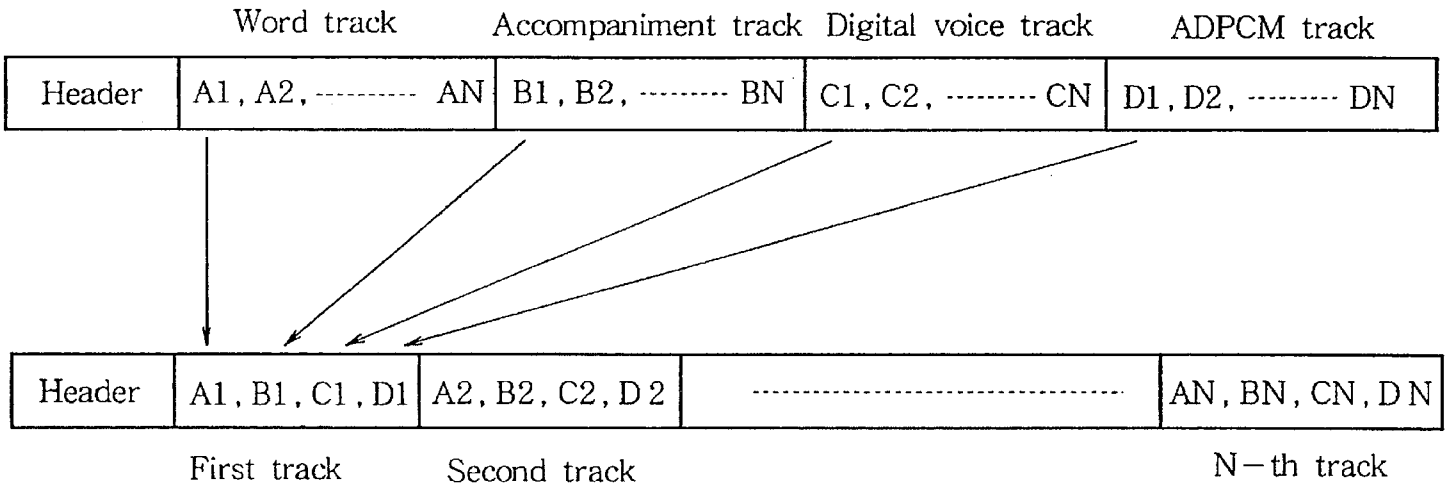
FIGS. 5(*a*) and 5(*b*) are a schematic diagram showing a song data format adopted in the inventive system.

The synthetic karaoke equipment is driven by the song data which has a data format generally shown in FIG. 5(*a*). The song data is comprised of a header and a subsequent serial train of a word track, an accompaniment track, a digital voice track an so on. Each track has a similar alternate arrangement of a duration and an event. The song data is transferred from the host station in the serial format so that the transfer of the song data is completed when the last track is received. Therefore, the karaoke performance is started after the last track is received by the karaoke system. The player must wait for a considerable time interval after the request to actually start the karaoke performance. For example, the typical song data has a length of 15 KB–20 KB for the header and 100 KB from the word track to the voice track. Such a length of the song data is transferred by about 15 seconds through the fast ISDN network having a data transfer rate of 8 KB per second. Actually, this net transfer time is added by overheads such as a calling time of the host station, a database access time in the host station and else so that the total transfer time reaches more or less 20 seconds. This waiting time is ten or more times as long as the retrieval time of the song data from the HDD, which is in the order of 1–2 seconds.

In view of this, the data transfer format is arranged as shown in FIG. 5(*b*) in the inventive total karaoke system.

Namely, in the original song data format shown in FIG. 5(*a*), the word track is divided into time-sequential sections of A1, A2, . . . , AN, the accompaniment track is likewise divided into time-sequential sections of B1, B2, . . . , BN, and the digital voice track is likewise divided into time-sequential sections of C1, C2, . . . , CN. Then, as shown in the FIG. 5(*b*) format, the first sections A1, B1 and C1 are collected from the respective tracks to compose a first track. Similarly, the second sections A2, B2 and C2 are collected to form a second track. In similar manner, the N-th sections AN, BN and CN are collected to form an N-th track. For example, in case of N=6, the data transfer of the first track having the length of about 15 KB is completed by about 2 seconds. The preceding data transfer of the header requires about 2 seconds, hence only 4 seconds are spent to receive the first track. Even if an overhead is added, the receipt of the first track may be finished by about 8 seconds. Upon receipt of the first composite track, the karaoke system obtains a top part of all the performance information including the song word data, the accompaniment data, the digital voice data and else to thereby readily start the top part of the karaoke performance accompanied by the word display and else. In estimation, the song data representative of a music piece of 3 minutes length is divided into the first track through the sixth track such that the karaoke system can commence about 30 seconds of the karaoke performance according to the first track of the song data. Accordingly, the karaoke system commences the karaoke performance after the first track is received, while the second and further tracks are continuously entered. After the performance of the first track is finished, the second track is performed while the remaining tracks are continuously entered. By such a manner of flying start, the karaoke system immediately initiates the karaoke performance to finish the same without interruption, while the song data is transferred in parallel to the song performance.

These of the song word track, the accompaniment track and the digital voice track have a relatively small data volume likewise the MIDI data. Occasionally, the song data may be added with a relatively great volume of data representative of, for example, a back chorus. In such a case, data compaction technology is adopted to reduce the data volume. In the FIG. 5(*a*) format, the song data contains the last additional track which carries an Adoptive Delta Pulse Code Modulation (ADPCM) data. The ADPCM data is compacted in the four-bit form by the re-sampling rate of 11 KHz or 22 KHz relative to the original data having the sixteen-bit form sampled by the rate of 44 KHz. Even though compacted, the ADPCM track may have a data length up to several hundreds KB, which needs a quite long transfer time. In view of this, as shown in the FIG. 5(*b*) transfer format, the ADPCM track is also divided into time-sequential sections of D1, D2, . . . , DN, and the respective sections are distributed separately to the first, second, . . . , N-th tracks for the quick data transfer. By such a manner, the karaoke song accompanied by the back chorus can be promptly initiated in the flying start mode.

Down loading of song data into HDD storage

There are various methods of down loading the song data transmitted through the ISDN network into the HDD storage 22C. In one method, the received song data is directly loaded into the HDD storage 22C. However, the HDD storage is used as a cache, hence only the frequently requested songs should be stocked in the HDD storage. In view of this, the present embodiment adopts an efficient method of preventing unwanted or rarely requested songs from the stocking. Namely, referring to FIG. 6, buffers 62A, 62B and 62C are set in the RAM 62. Firstly, the down load buffer 62A temporarily latches the song data admitted from the ISDN network by CPU 61. Then, the latched song data is written into the performance buffer 62B to effect the karaoke performance. After starting the performance, the player soon judges if the performed song is just the requested song. Occasionally, the singer orders canceling of the performed song which is different from the requested song. In such an occasion, the canceled song data is erased without stocking into the HDD storage 22C, because the canceled song is an inadvertently designated one, and may be a rarely requested one. On the other hand, if the performed song is not canceled within a certain time interval (for example, 30 seconds) after the start of the performance, it is judged that the performed song is exactly the requested one. In such a case, the latched song data is transferred from the down load buffer 62A to the HDD buffer 62C, and then stocked in the HDD storage 22C.

Erase of song data from the HDD storage

Figure 6:
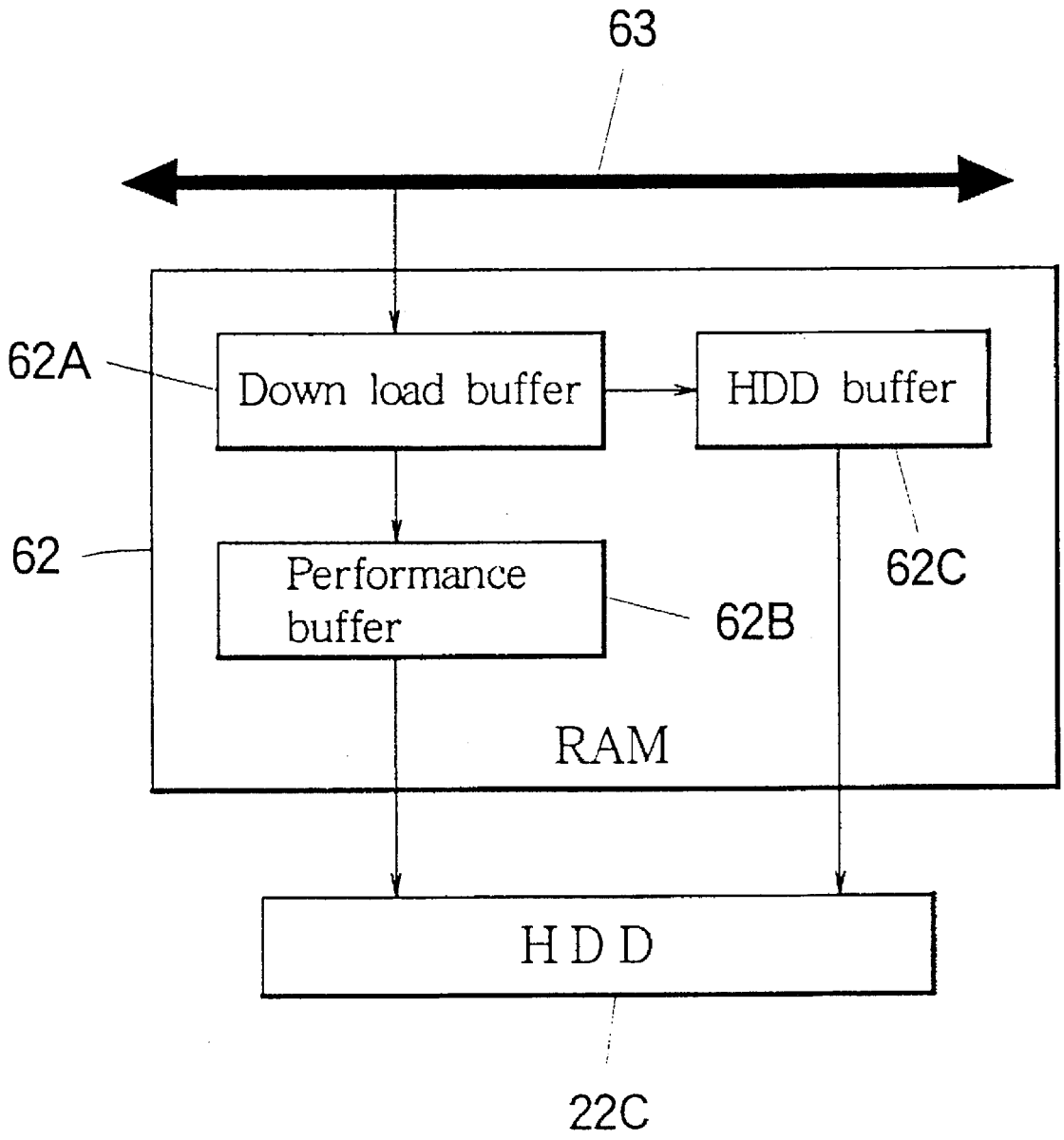
FIG. 6 is a functional block diagram of various data buffers.

Alternatively to the FIG. 6 method where the unwanted song data is prevented from the stocking into the HDD storage 22C, the canceled song data may be reserved in the HDD storage HDD 22C, while being labeled by a cancel mark. If shortage of a vacant memory area occurs in the HDD storage 22C, the labeled song data is erased first of all. As long as the labeled song data is stored, the HDD storage 22C can readily supply the same in response to recurrent requests of the same song without accessing the host station. This erase method refers to the cancel mark for data maintenance of the HDD storage in addition to or in place of reference to a frequency and an interval of the data usage.

Arrangement of the song data

Figure 7:
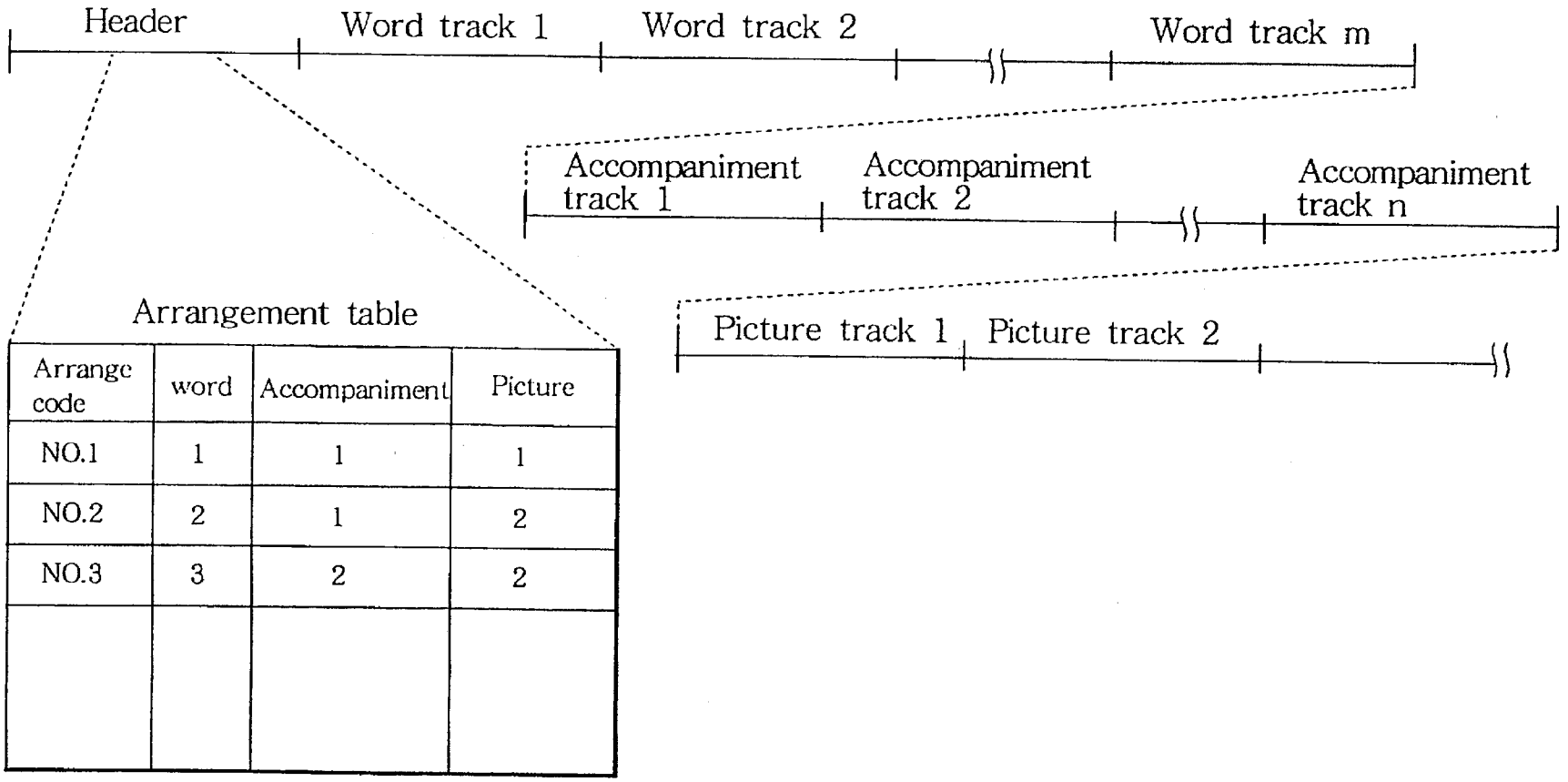
FIG. 7 is a schematic diagram showing another song data format.

In contrast to the FIG. 5(*a*) format where each song is assigned with one set of data tracks, a format of FIG. 7 provides plural sets of data tracks for one song such that the user can freely arrange the data tracks. For example, the song data involves three word tracks, i.e., the word track 1 containing regular Japanese words, the word track 2 containing a foreign language version thereof, and the word track 3 containing parody words. In similar manner, th accompaniment tracks 1, 2, . . . , N and the picture tracks 1, 2, . . . contain different versions of accompaniments and pictures, respectively. Further, the header of the song data contains an arrangement table which lists various combinations of the data tracks, each combination being identified simply by an arrange code. In the illustrated example, the arrange No. 1 represents the regular arrangement composed of the word track 1, the accompaniment track 1 (practically containing multiple subtracks) and the picture track 1. The arrange No. 2 represents the foreign arrangement, and the arrange No. 3 represents the parody arrangement. As compared to the simple format in which a separate song data is set for a different arrangement, such a complex format can efficiently save the total data volume since the data tracks can be commonly used for different arrangements, thereby contributing to reduction in the communication time and the memory capacity. Further, since a plurality of the data tracks are associated with one another in the same song, the data maintenance can be facilitated advantageously. In spite of such a complex data format, the user does not need to recognize detail of different arrangements. Namely, the Japanese language version and the foreign language version of the same song are indicated by different song item codes in a list book of the karaoke songs, hence the user simply designates a desired item code to thereby automatically select a corresponding arrangement.

Font arrangement of word characters

Figure 8:
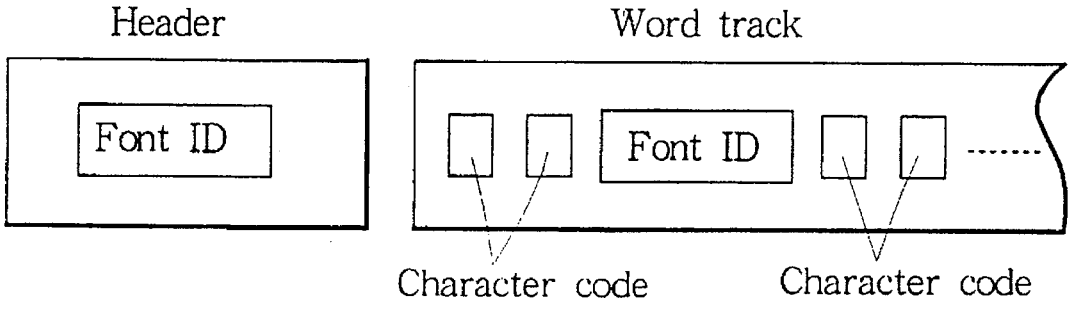
FIG. 8 is a schematic diagram showing an arrangement of font identification data.

A multiple of word tracks may be prepared correspondingly to different character fonts in order to arrange the font of the word characters. However, such a data format may disadvantageously increase a data volume. In order to avoid such a redundancy, as shown in FIG. 8, the present embodiment utilizes an efficient data format in which a font identification code is inserted into the header or the word track to specify a desired font. The font of the word characters is successively changed everywhen a new font identification code is detected. The word track is composed of a time-sequential arrangement of character codes effective to display the song word. In case that the header contains an initial font identification code, a corresponding font block stored in the HDD storage 22C of FIG. 4 is developed in the working RAM 62 so as to start the word display by the character codes in the initial font. Then, another font identification code inserted in the middle of the word track is detected so that the old font block is replaced by a new font block in the working RAM 62 to thereby change the font of the displayed word according to the newly detected font identification code. Normally, the font data is stored in a ROM; however, the present embodiment utilizes the HDD storage 22C to separately store various fonts which are selectively developed in the working RAM. By such an operation, the host station 30 can manage change and addition of the fonts, while the karaoke system does not need an extra font ROM. Consequently, not only the font of the same language word can be changed in terms of letter size, letter type and else, but also this font designation function is utilized in extensive manner such as the initial Japanese language words can be switched to foreign language words in the middle of the karaoke performance. Namely, the font identification code contained in the song data transmitted from the host station is switched, while a corresponding font is retrieved from the HDD storage 22C and is developed in the working RAM 62.

Multimedia sequencer

The multimedia sequencer 23B is basically composed of an MIDI sequencer and is provided with operating system (OS) function to concurrently execute parallel tasks. Consequently, the multimedia sequencer 23B can execute in real time basis a multiple of events of plural tracks contained in one song data in synchronization with each other under the software control. The "event" covers a wide variety of representations involved in the karaoke performance, including instrumental accompaniment, song word display, background picture, sound effect, external instrument control and so on. The multimedia sequencer 23B receives the song data which is read out from the working RAM 62 by means of the CPU 61. As shown in FIG. 5(*a*), the song data is composed of the word track, the accompaniment track in the form of an MIDI track, the voice track, and the additional ADPCM track. The multimedia sequencer 23B distributes the MIDI data to the tone generating processor 23C to synthesize the karaoke accompaniment. Further, the sequencer 23B feeds the ADPCM data to the ADPCM decoder 66 where the compacted ADPCM data is expanded and decoded. Moreover, the sequencer 23B controls the ADPCM decoder 66 according to event information contained in the voice track so as to regulate decoding of the ADPCM data.

Figure 9:
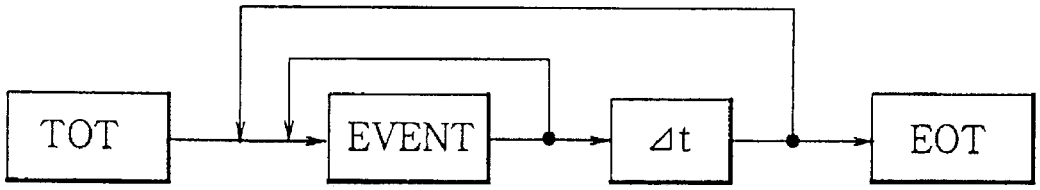
FIG. 9 is an illustrative diagram showing a routine of executing MIDI events.

Referring to FIG. 9, the regular MIDI track is comprised of an alternate arrangement of an event and a duration (waiting interval) Δt, which starts from the top of track (TOT) and terminates by the end of track (EOT). The sequencer 23B sequentially processes each event in repetitive manner as indicated by the arrows of FIG. 9.

Figure 10:
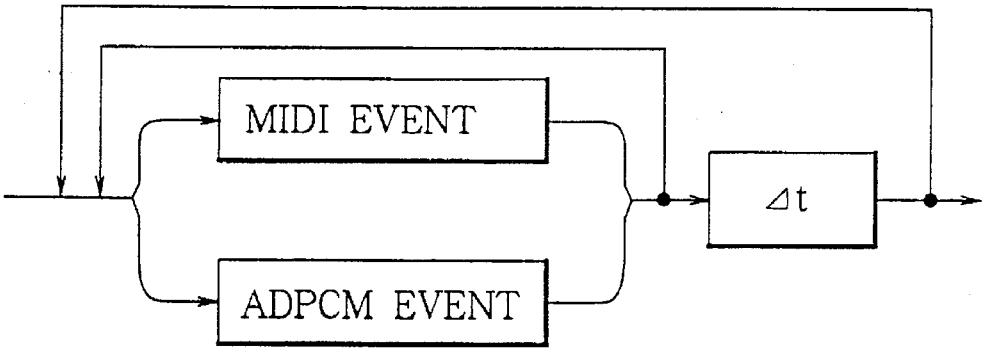
FIG. 10 is an illustrative diagram showing a routine of executing ADPCM events concurrently with the MIDI events.

On the other hand, in case that the song data is added with the ADPCM data shown in FIG. 5(*a*), the ADPCM event is executed in parallel to execution of the MIDI event as illustrated by FIG. 10. The ADPCM event is prescribed, for example, in the digital voice track, hence the timing of executing the ADPCM event can be synchronized with the MIDI event which is prescribed in the accompaniment track under the software control. Each ADPCM event contains various items such as (1) designation of ADPCM tone, (2) inactive status of pitch shift, (3) tone volume, and (4) pitch shift amount.

On the other hand, the ADPCM data typically represents musical tone waveforms such as a back chorus voice waveform involved in the karaoke performance. Although compacted, the ADPCM data has a data volume for greater than that of the MIDI data. However, as long as the back chorus is concerned, a certain chorus part may be repeatedly added in the same song while simply being modulated. In view of this, common chorus parts are provisionally prepared as an independent set of the ADPCM data. During the course of reproduction, the provisionally prepared ADPCM data is selected to synthesize the back chorus involved in the reproduced song. Such a technique can save the total volume of data transferred from the host station and can reduce the memory capacity. The "designation of ADPCM tone" involved in the ADPCM event is utilized to select desired one of the ADPCM waveforms.

The ADPCM data may be reproduced in a pitch-shifted form. For this pupose, the "pitch shift amount" is involved in the ADPCM event so as to designate a desired degree of the pitch shift. The pitch shifter 67 shown in FIG. 4 carries out the pitch shift of the ADPCM tone. The pitch shifter 67 may be composed of a digital signal processor called "karaoke processor (KP)". The pitch shifter 67 can conduct not only modulation in which the song is temporarily pitch-shifted, but also transposition in which the song is entirely transposed by the use's command. In such a case, the pitch shift may be superposed further to the transposed form of the song.

The ADPCM data may be used to represent a waveform of effect tones besides the back chorus tones. In such a case, the "inactive status of pitch shift" involved in the ADPCM event is set to avoid unnatural pitch shift of the certain effect tone. The inactive status is effective to inhibit the pitch shift of the ADPCM tone even if the user commands the transposition. Lastly, the "tone volume" is set to automatically control the volume of the ADPCM tone each event.

Common chorus/Phrase chorus

The back chorus is classified into a general or common chorus and a specific or phrase chorus. The common chorus is composed of a rather simple sound like a combination of a short consonant and a prolonged vowel such as "WAAA . . . " and "RAAA . . . " which may be repeatedly added in the same song, or a train of simple voices such as "WAAWAAWAA . . . " or "WA, WA, WA, . . . " which may be used for different songs. On the other hand, the phrase chorus is composed of a particular phrase such as "NAGASAKIWAAA" specific to a particular song. The synthetic karaoke equipment can treat the common chorus composed of simple sounds as a kind of musical tones so as to synthetically generate the chorus sounds by the tone generating processor. Such a treatment can save the total data volume of the back chorus to thereby shorten the data communication time as well as to reduce the data memory capacity.

Figure 11:
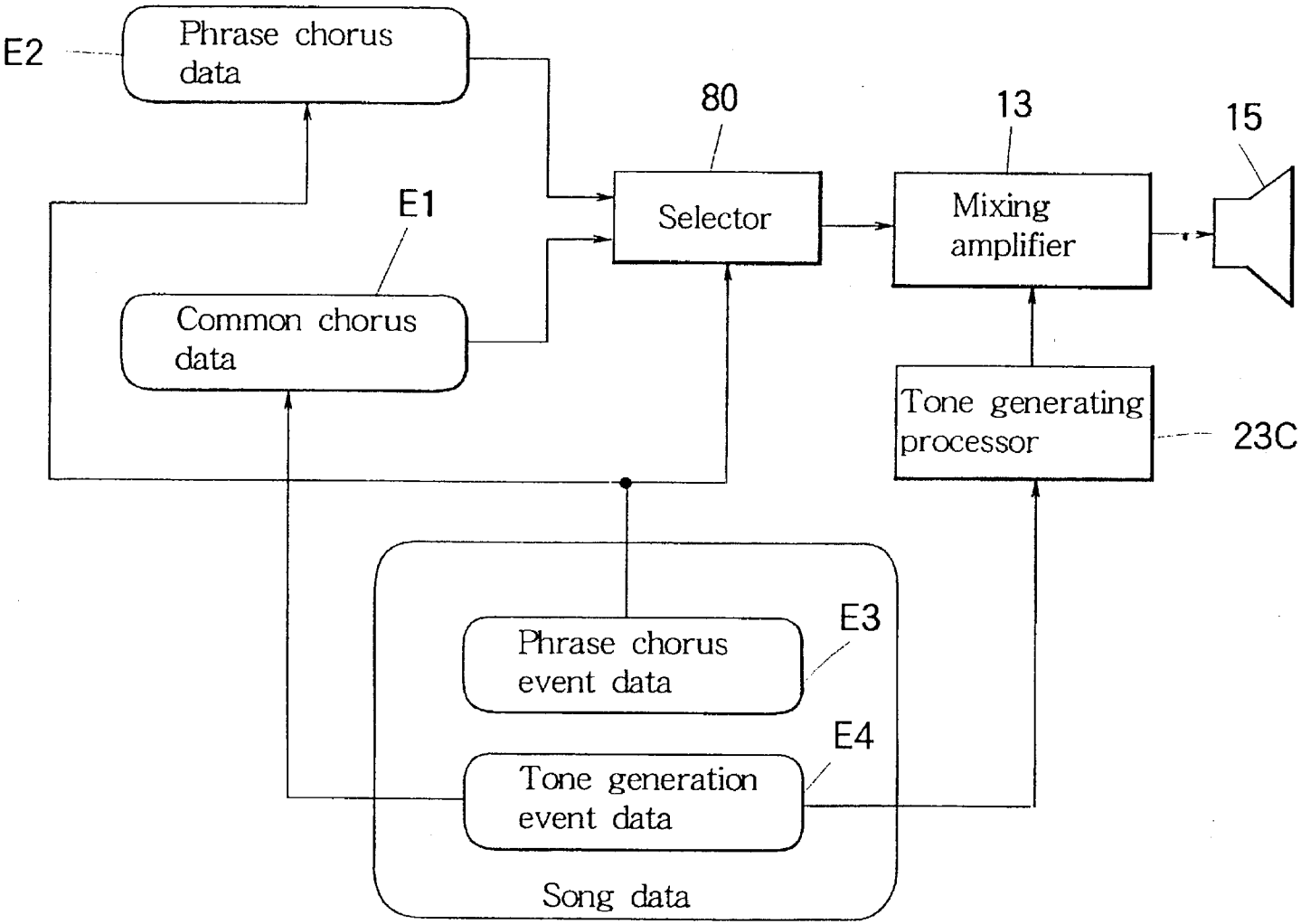
FIG. 11 is an operational block diagram showing a process of producing a common part of a back chorus from a tone generating processor.

Referring to FIG. 11, detailed description will be given for process of the common chorus/phrase chorus. With regard to the common chorus data El, typical voice waveforms such as "WAAA," "RAAA" and "AAA" are provisionally sampled, and the sampled waveform data is memorized in a library of the tone generating synthesizer 23C. With regard to the phrase chorus data E2, a waveform data representative of a specific vocal waveform such as "NAGASAKI . . . " is stocked in the form of ADPCM data or else in the HDD storage 22C or else for each song. Upon request, the phrase chorus data E2 is transferred to the RAM 62 (FIG. 4) together with the song data. The phrase chorus data E2 is processed by means of the ADPCM decoder 66 based on a phrase chorus event data E3 contained in the digital voice Ira& of the song data (FIG. 5(*a*)). On the other hand, the common chorus data E1 is processed by means of the tone generating processor 23C (FIG. 4) according to a tone generation event data E4 contained in the MIDI track of the song data. Either or occasionally both of the common chorus data E1 and the phrase chorus data E2 is selected by a selector 80 which may have OR logic function. The selected one of the common and phrase chorus data E1, E2 is mixed with other musical tone data fed from the tone generating processor 23C by the mixing amplifier 13, and is then sounded by the loudspeaker 15.

Compaction and Expansion of chorus data

The back chorus has generally a great data volume. In view of this, the host station 30 compacts the original back chorus data, while the total karaoke system expands the compacted back chorus data. The data compaction is carried out by ADPCM in this embodiment. In such a case, the ADPCM decoder 66 expands the compacted back chorus data in the karaoke system. Generally, the back chorus may contain the common chorus and the phrase chorus as mentioned foregoing. In this embodiment, the phrase chorus data is subjected to the ADPCM, while the common chorus data is separately processed in the tone generating processor. Alternatively, the common chorus data may be also subjected to the ADPCM.

In the host station, the data compaction is applied to a digitally sampled phrase chorus data. In such a case, the original data is re-sampled to carry out frequency compaction. The re-sampling rate is written into the header of the song data (the file) as decode information. Bit compaction of the original data is also carried out by the ADPCM technique or else, and its compaction information is likewise written into the header as decode information. For example, the regular digital data of 16 bits recorded in the Compact Disc has a sampling rate of 44.1 KHz, and this regular digital data is compacted into the ADPCM data of 4 bits re-sampled at 22.05 KHz or 11.025 KHz.

Figure 12:
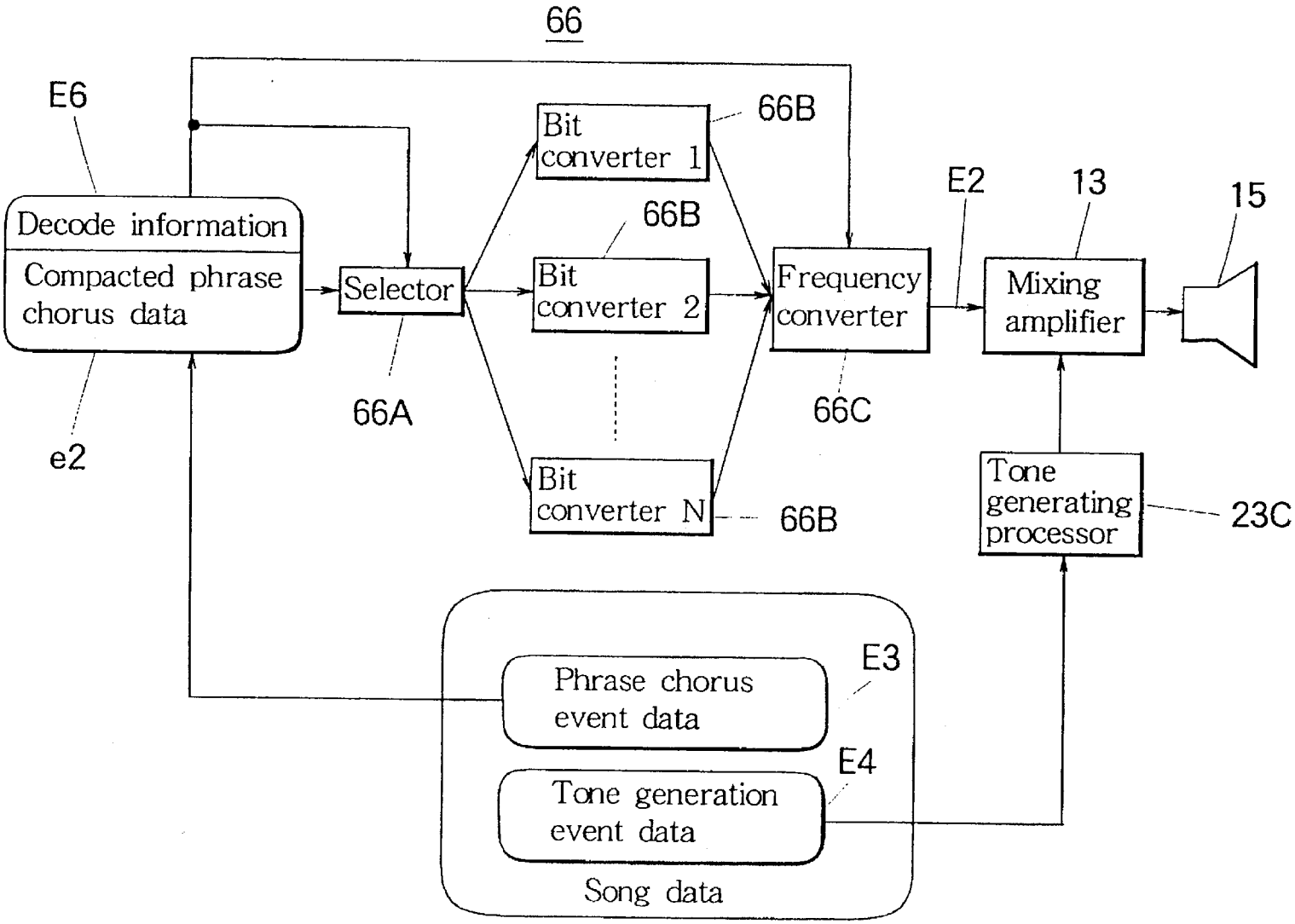
FIG. 12 is an operational block diagram showing a process of expanding a phrase chorus data aside from the tone generating processor.

Referring to FIG. 12, in the total karaoke system, the ADPCM decoder 66 expands the compacted ADPCM data e2 of the phrase chorus according to the decode information E6 which indicates the compaction condition such as the re-sampling rate. Namely, one of bit converters 66B is selected by means of a selector 66A, and a frequency converter 66C is set with a suitable conversion frequency according to the decode information E6. Expanded phrase chorus data E2 by such a manner is mixed by the mixing amplifier 13 with other musical tone data processed by the tone generating processor 23C. This data compaction technology can efficiently save the data volume to be transferred on line, and can reduce a memory capacity of the HDD storage 22C. As described before, the decode information is written in the header of the song data shown in FIG. 5(*a*). Alternatively, the decode information E6 may be variably set for individual phrases. In such a case, various ones of the decode information is distributed to the digital voice track. The digital voice track is divided into plural sections corresponding to the individual phrases. Each section is provided with a sub-header where the decode information is prescribed. The data compaction condition can be varied for different phrases within the same song, while the variable data compaction condition is written into the corresponding section of the digital voice track as the decode information. For example, an important or attractive part of the back chorus data can be moderately compacted by a higher re-sampling rate With a greater bit number as compared to the remaining parts. In variation, the data compaction condition is set variably in correlation to a tone volume of the respective phrases of the back chorus.

Tone pitch control

Figure 13:
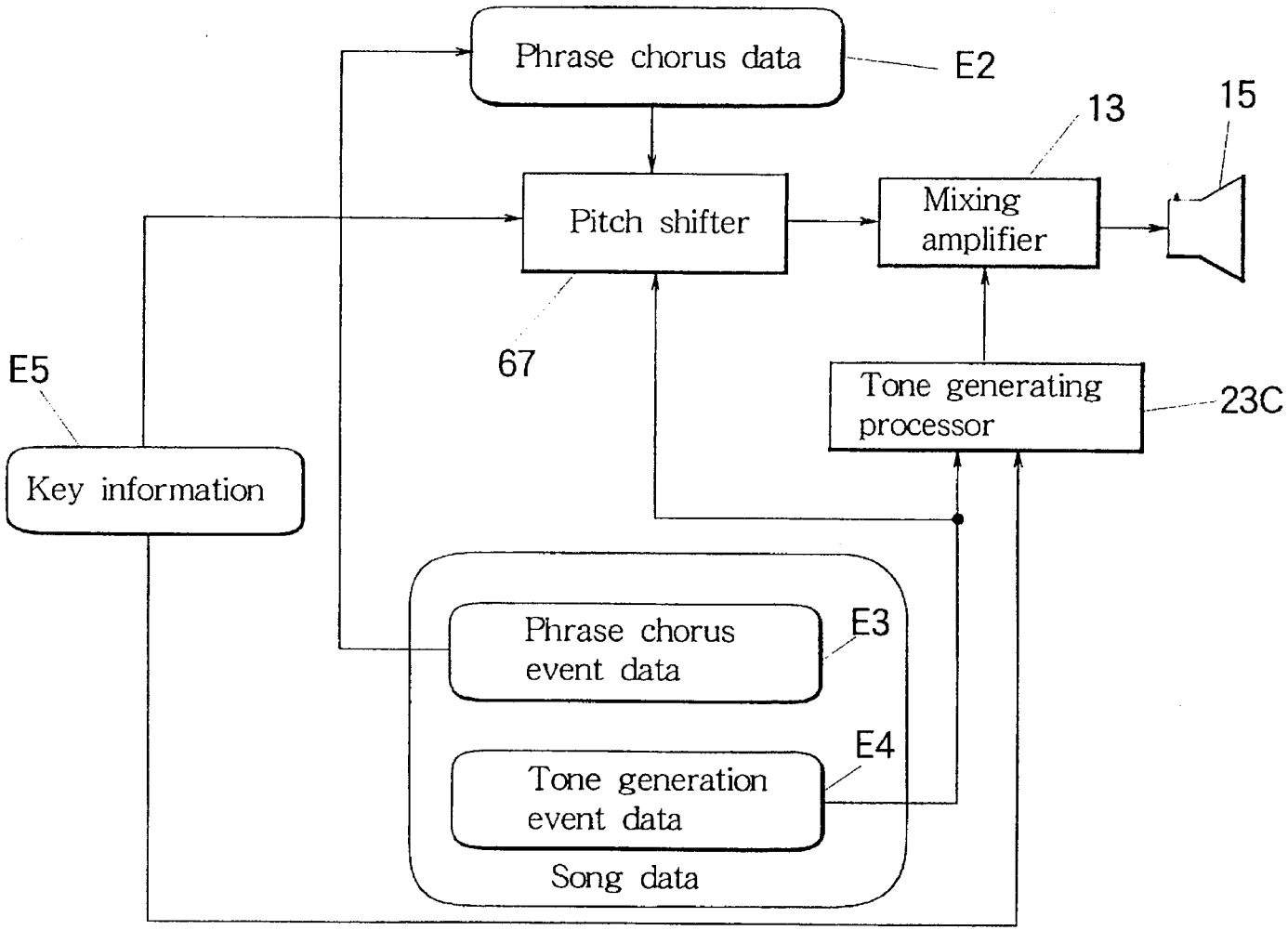
FIG. 13 is an operational block diagram showing a process of pitch shift.

In the FIG. 4 construction, the pitch shifter 67 receives the output of the ADPCM decoder 66 to carry out tone pitch regulation or the pitch shift according to given key information. The pitch shift includes modulation by which the key is temporarily changed in the middle of the song, and transposition by which the key of the song is totally pitch-shifted. Referring to FIG. 13, one example is given for operation of the pitch shifter 67, where one phrase chorus data E2 is repeatedly reproduced while being pitch-shifted in the back chorus. For example, a specific phrase "NAGASAKIII" is repeatedly sounded while its key is successively raised to form the back chorus. As shown in FIG. 13, the externally inputted key information E5 is fed to the pitch shifter 67 and to the tone generating processor 23C. The pitch shifter 67 pitch-shifts the phrase chorus data E2 of the back chorus according to the inputted key information E5. The phrase chorus data E2 is fed to the pitch shifter 67 according to the phrase chorus event data E3. On the other hand, the pitch shift of the regular musical tones is controlled by the tone generating processor 23C. Further, when modulation occurs in the song, the modulation information is fed to the pitch shifter 67 from the sequencer 23B so as to concurrently change the key of the back chorus. By such a manner, the same phrase chorus data can be commonly used for the back chorus of a different key.

Inhibition of pitch shift for effect sound

The pitch shifter 67 may receive an effect sound besides the back chorus. The pitch shift of the effect sound may seriously hinder expected acoustic effect to thereby adversely cause incompatibility. In view of this, the before-mentioned inactive status is set for the effect sound to inhibit the pitch shift thereof to maintain the original tone key even though the pitch information E5 is inputted.

Compensation for delay of chorus data

Upon issue of a sound production command, the chorus data passes through the ADPCM decoder 66 and the pitch shifter 67 before reaching the effect mixer 68 (FIG. 4) to thereby cause a certain delay. For example, the pitch shifter 67 may structurally adds a process delay in the order of 30 ms±30 ms. In view of this, compensation for the delay is required in order to output the chorus sound concurrently with the accompaniment sound outputted from the MIDI tone generating processor in real time basis. For this, the time sequential event data of the back chorus is written into the voice track or chorus sound track precedingly by about 30 ms to corresponding MIDI event data written in the MIDI track. The sequencer 23B (FIG. 4) feeds the chorus event data to the ADPCM processor 66 precedingly to the MIDI event data to thereby cancel out the delay between the chorus sound and the MIDI sound.

Sound field control

Figure 14:
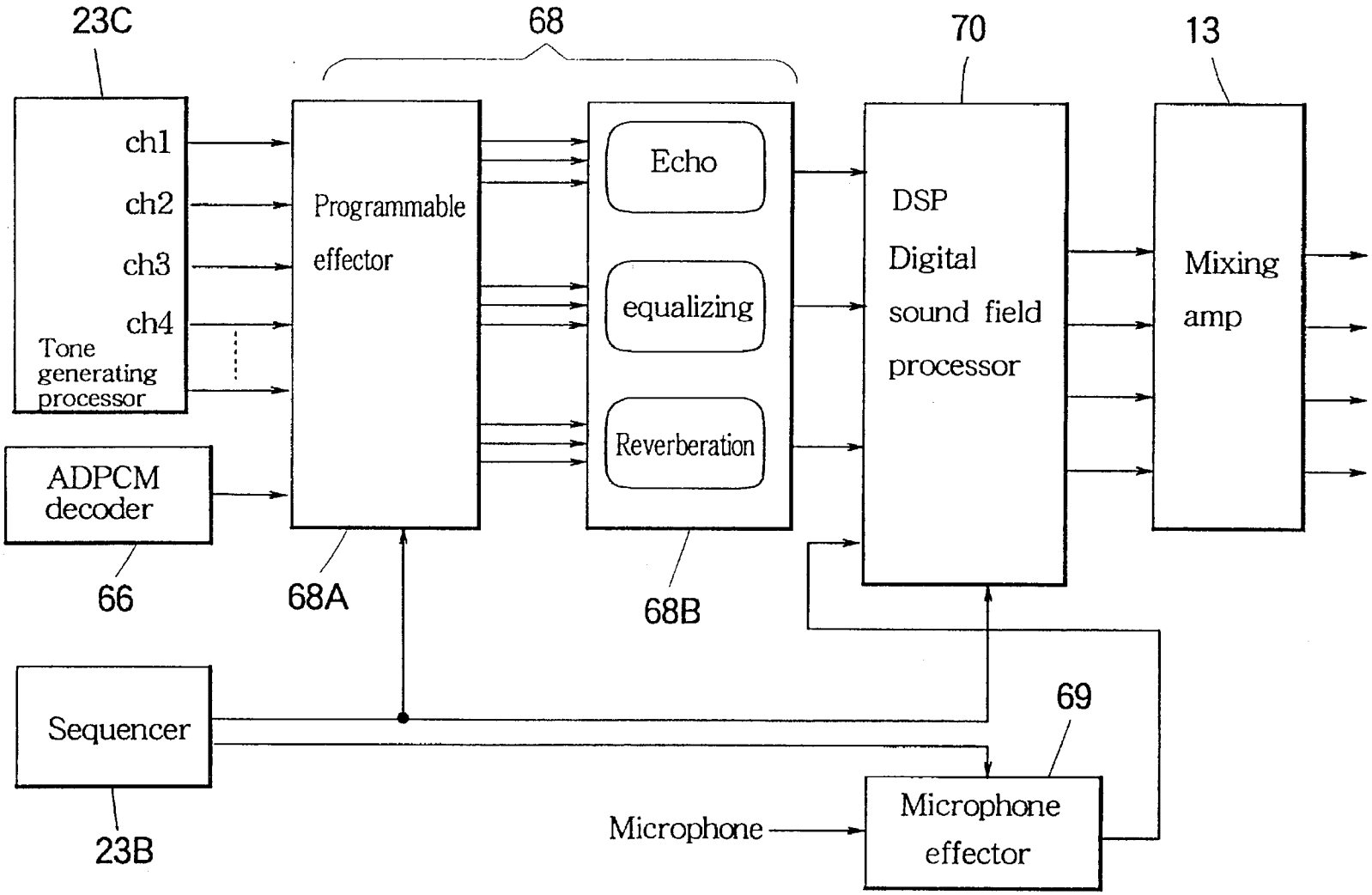
FIG. 14 is an operational block diagram showing multiple controls by a multimedia sequencer.

Referring to FIG. 14, the sequencer 23B further controls the microphone effector 69 and the digital sound field processor (DSP) 70 in synchronization with the progression of the karaoke song performance in addition to the control of the pitch shifter 67. The effect mixer 68 receives the instrumental accompaniment tones from the tone generating processor 23C through a multiple of channels, such as a guitar tone from the channel 1, a piano tone from the channel 2, a violin tone from the channel 3 and so on. The effect mixer 68 receives also the output of the ADPCM decoder 66 through the pitch shifter 67, representative of a vocal waveform data carried by the ADPCM track. The effect mixer 68 has a programmable effector 68B at its input stage for selectively distributing the respective channel outputs to a succeeding processor 68B according to a select control signal fed from the sequencer 23B. The processor 68B imparts various acoustic effects such as echo, equalizing, reverberation and so on to the selected channel outputs.

The digital sound field processor (DSP) 70 receives the output of the effect mixer 68 to apply thereto a desired sound field according to a control signal from the sequencer 23B in matching with the song performance. The sound field processor 70 digitally forms a plurality of echo waveforms having different delays and magnitudes based on the inputted waveform to synthesize a musical sound. Consequently, a desired spread of the sound field is obtained as if the song is performed in a concert hall, a live spot or else. The sound field processor 70 can be coupled to a sound system composed of multiple loudspeakers 15 to more efficiently generate the sound field. For example, the sound system may be composed of six or seven units of the loudspeakers arranged such that four units are positioned front right, front left, rear right and rear left, respectively, and three additional units are positioned front middle, center left and center right, respectively. Such a sound field system is disclosed in the U.S. Pat. No. 5,027,687.

The microphone effector 69 is optionally connected to the sound field processor 70 in the present embodiment. The microphone effector 69 imparts to the singing voice picked up by the microphone various desired acoustic effects such as monoral-to-stereo conversion, echo, excitation, harmonization, equalizing and else. The microphone effector 69 is operated according to a timing control signal fed from the sequencer 23B so as to generate the acoustic effects in synchronization with the progression of the song performance.

As described above, the sequencer 23B provides the timing control signals effective to control the sound field processor 70, the effect mixer 68 and the microphone effector 69. The sequencer 23B may provide additional timing control signals effective to control other equipments including a display, an illumination and a stage. All the control signals are generated according to time sequential event data prescribed in a control track involved in the composite song data. The multimedia sequencer 23B reads out the control track from the RAM 62 concurrently with other tracks including the MIDI track so as to totally systemize all the equipments in synchronization with the karaoke song performance.

Information display of request song

Figure 15:
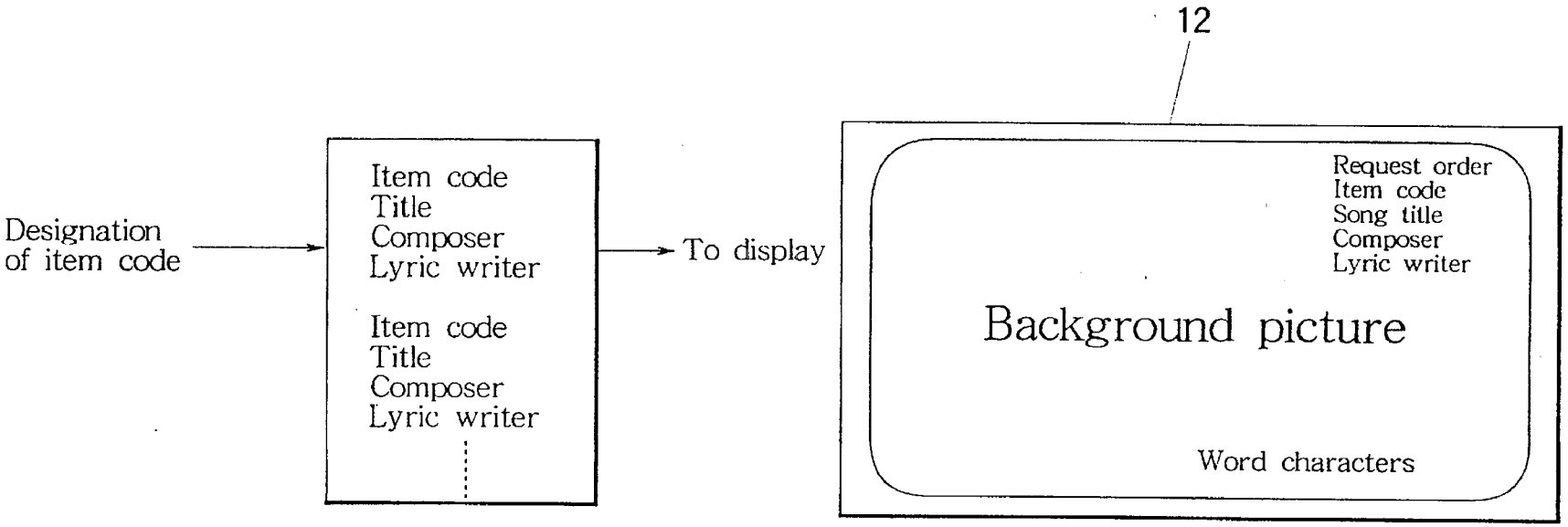
FIG. 15 is an illustrative diagram showing display of requested song item information.

In the conventional karaoke apparatus, a monitor CRT simply displays an item code of a requested song for indication of reservation. Therefore, the requester cannot recognize an inadvertent designation of the song until the same is actually sounded. In order to solve this inconvenience, as shown in FIG. 15, the HDD storage 22C is set with a display information dictionary. Upon request of a desired song, the monitor CRT 12 is driven to display the song item code, song title, composer name, lyric writer name, request order and else. The requester can confirm the designated song by the displayed information in terms of the title and additional information if the title is not distinctive. The information is displayed, for example, at an upper right corner of the display field so as to avoid disturbance of displayed picture and characters. Such a confirmation work of the requested song is helpful to avoid unnecessary access to the host station from which the song data is transmitted to the karaoke system of the musical tone synthesis type. This confirmation work is also useful in the playback type karaoke such as LD karaoke since an inadvertent request frequently occurs.

Automatic transposition

Figure 16:
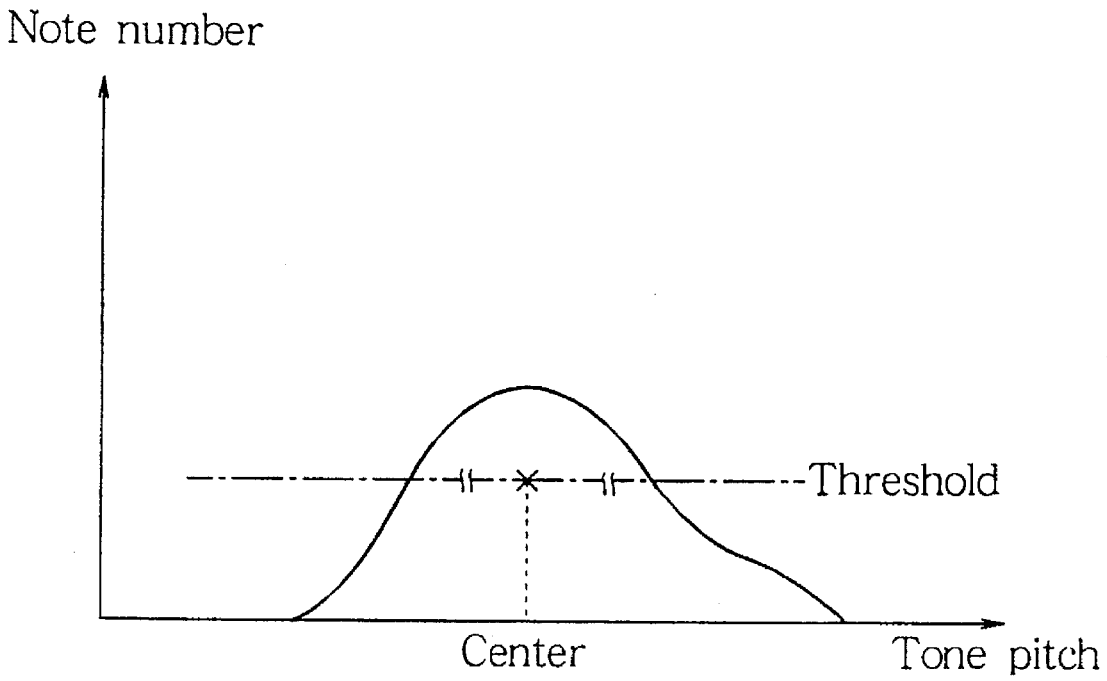
FIG. 16 is a graph showing determination of a center pitch value of a given karaoke song.

Automatic transposition is introduced in the present invention such that an optimum transposition is automatically determined when the user designates a preferable practical voice range to thereby produce a transposed accompaniment. In detail, a range of the most recurrent tones is provisionally memorized in the header of each song data. When the user designates a center level or upper and lower limits of his own practical voice range, the karaoke system sets an optimum key to automatically effect the transposition such that the center of the designated voice range matches with the center of the tone range of the karaoke song. The center of the karaoke song range is determined, for example, as shown in FIG. 16. Note numbers are counted in terms of the tone pitch to obtain a distribution curve of the karaoke song. Alternatively, the product of each note and duration is counted instead of the note numbers. The distribution curve is sliced by an adequate threshold level to obtain an effective range. A center value of the effective range is written into the header of the song data. Among various automatic transposition schemes for facilitating vocal performance of the karaoke song, the exemplified method of matching the center of the voice range with the center of the accompaniment tone range is based on the fact that the most frequently occurring tone range is suitably adjusted to totally facilitate vocal performance of the karaoke song throughout the entire range.

Figure 17:
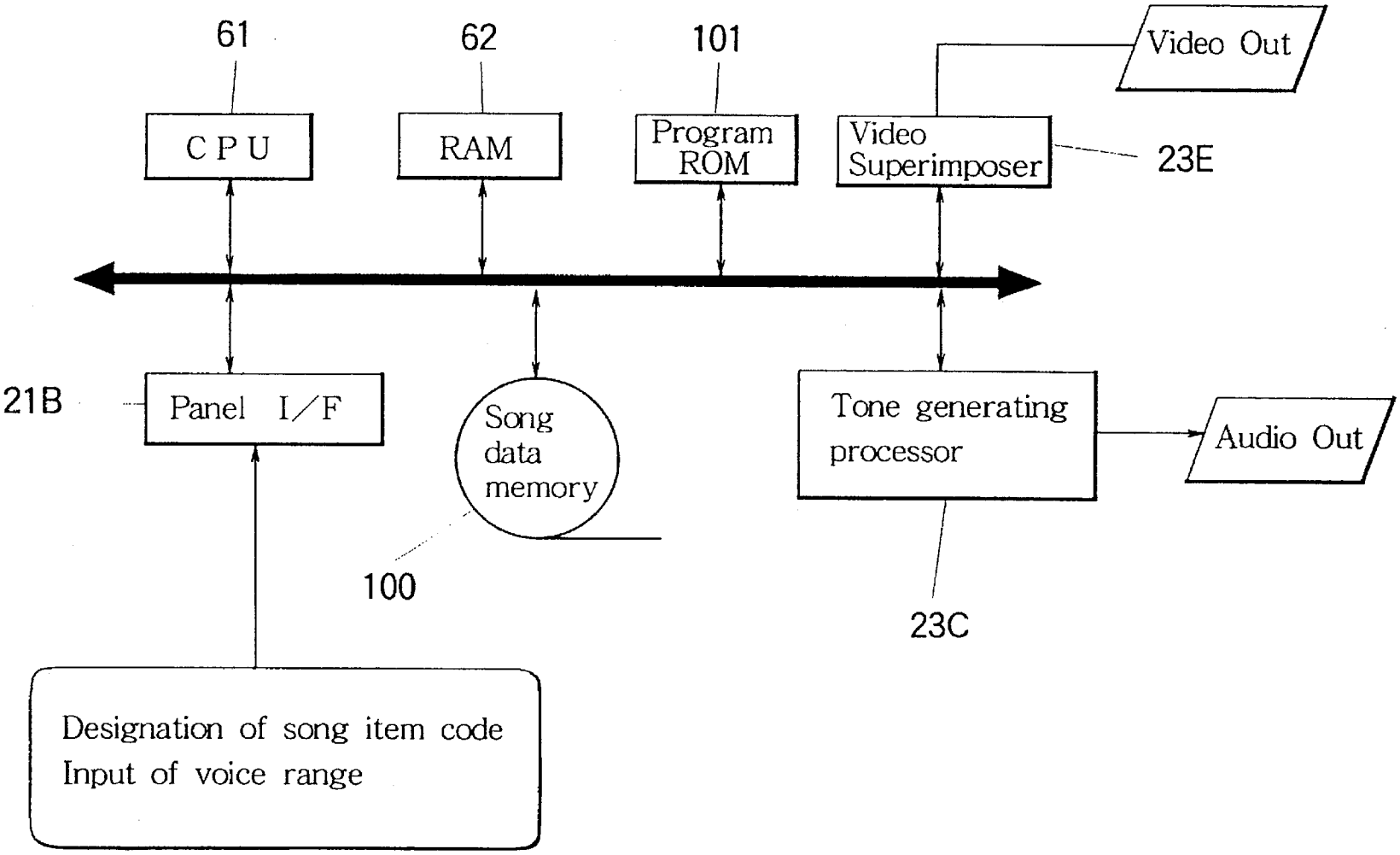
FIG. 17 is a block diagram showing a first example of automatic transposition.
Figure 18:
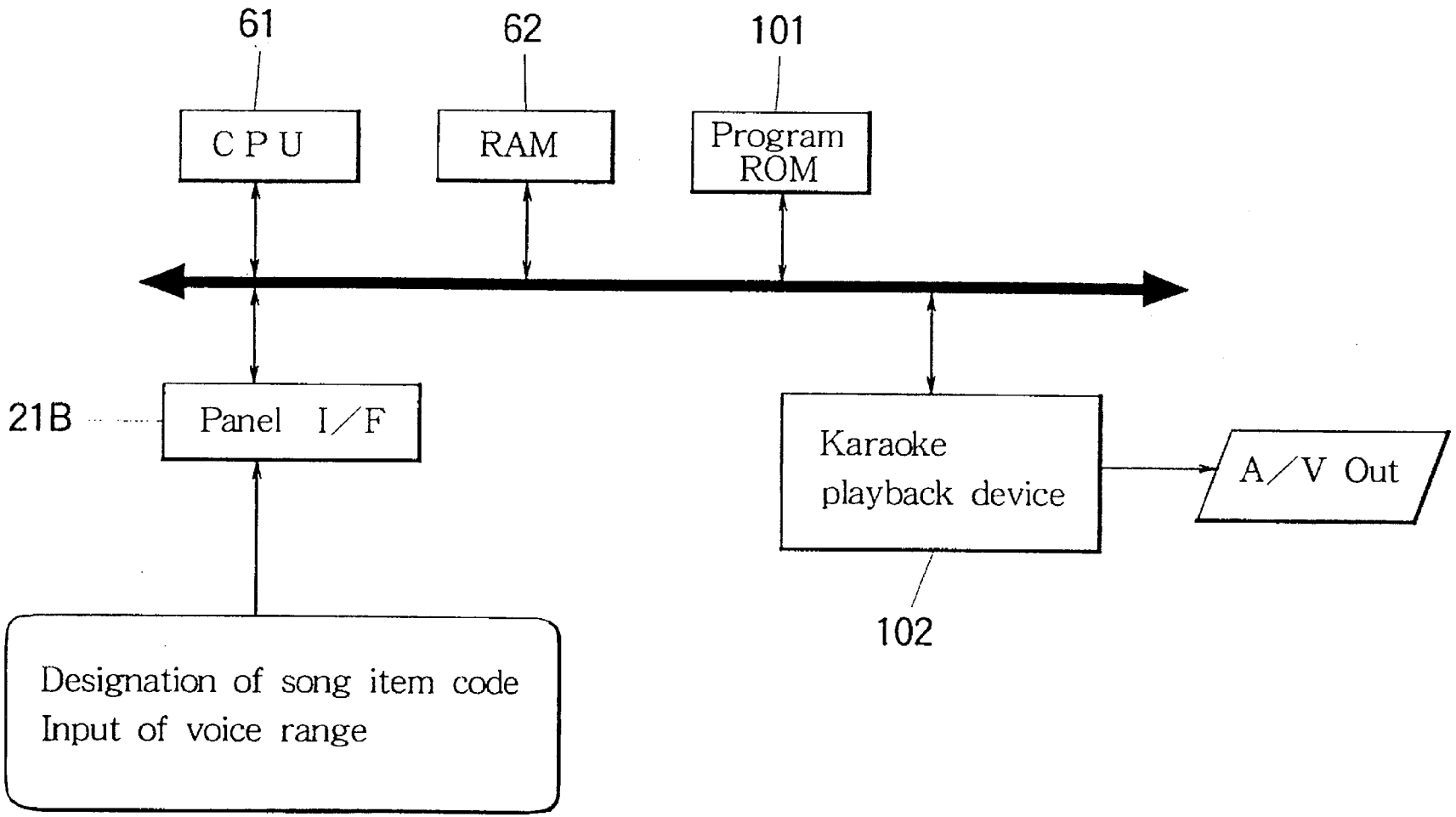
FIG. 18 is a block diagram showing a second example of the automatic transposition.
Figure 19:
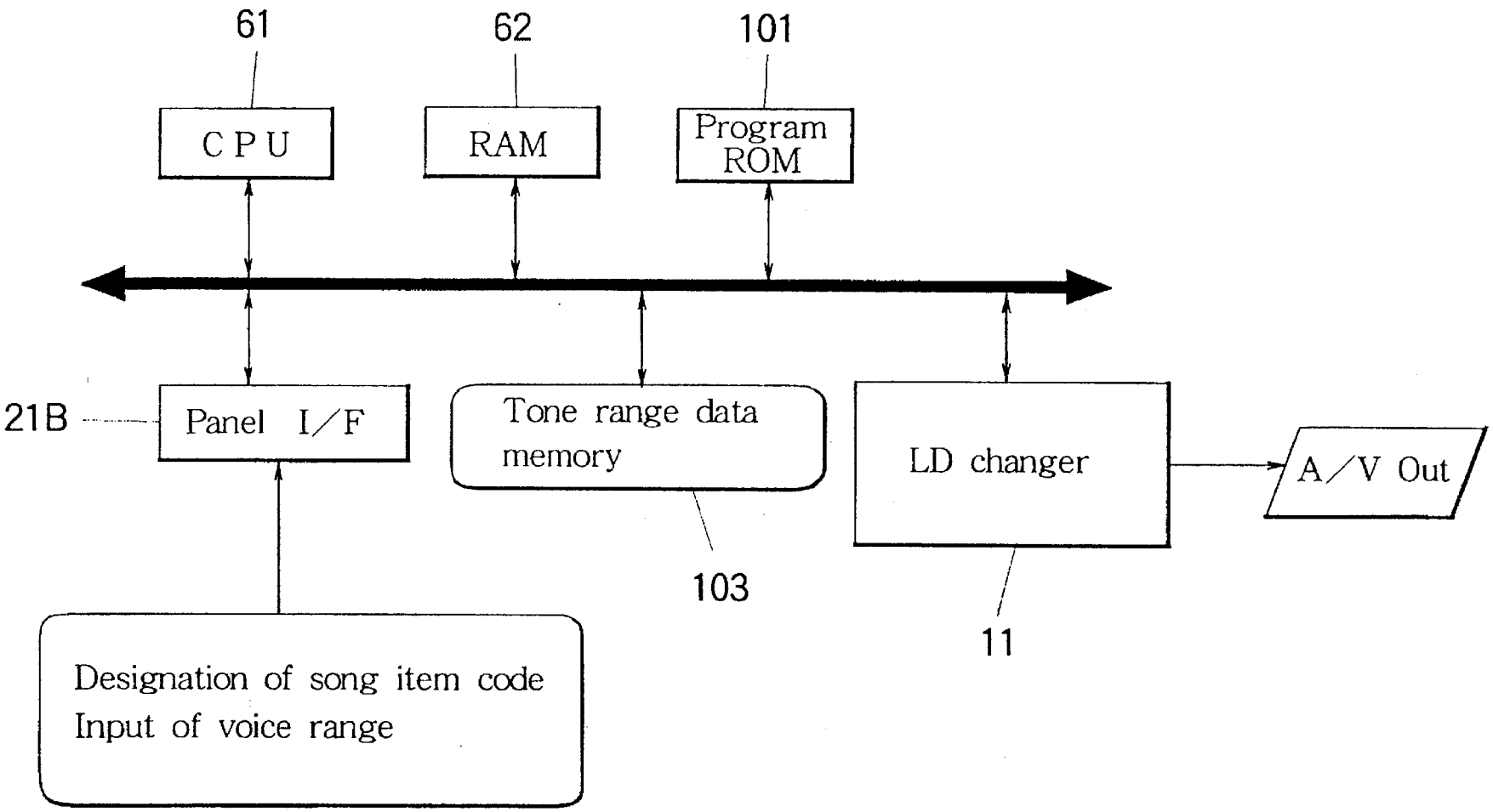
FIG. 19 is a block diagram showing a third example of the automatic transposition.

As shown in FIG. 17, with regard to the synthetic karaoke mode, a song data memory 100 is provided in the HDD storage 22C. The center value of the accompaniment tone range is read out from the song data memory 100 for use in the automatic transposition by means of the CPU 61 according to a program stored in a program ROM 101. With regard to the playback karaoke mode using a digital record medium such as CDG and CDI, as shown in FIG. 18, the tone range data is provisionally stored in a karaoke playback device 102 containing CDG/CDI. This tone range data is retrieved according to the requested song item code for use in the automatic transposition. Further as shown in FIG. 19, with regard to the playback karaoke mode using LD which cannot memorize a digital data, a tone range data memory 103 is separately provided for use in the automatic transposition. The tone range data memory 103 may be provided as a part of the HDD storage 22C.

Connection to external MIDI instrument

As shown in FIG. 4, the present karaoke system is provided with the MIDI interface 64 for connection to the external MIDI instrument 42 such as a percussion instrument to receive therefrom an external MIDI data representative of a percussive tone or other additional tones. The CPU 61 retrieves the external MIDI data from the MIDI interface 64, and feeds the same to the sequencer 23B. The sequencer 23B controls the tone generating processor 23C to assign one channel to the external musical instrument 42 so as to produce the percussive tone or else without using a separate tone generator for the external musical instrument. For this, the karaoke song data is provisionally arranged such that one of all the channels (for example, 16 channels in a single system, or 32 channels in a double system) is reserved in the tone generating processor 23C for the external MIDI instrument. Alternatively, the CPU 61 selectively distributes the external MIDI data received from the interface 64 to a currently vacant one Of the MIDI channels, which is not working for processing of the internal MIDI data.

Merge of internal and external MIDI data

Generally, the MIDI data starts from a status byte followed by data bytes to form an 8 bit data stream. In the present embodiment, the external MIDI data enters through the interface 64 asynchronously with the internal MIDI data read out from the RAM 62 for the karaoke accompaniment. Thus, a clash of the asynchronous data would cause data destruction. In order to avoid this, merge is conducted to avoid the clash between the internal and external MIDI data. When the external MIDI data enters from the separate musical instrument while the internal MIDI data circulates in the karaoke system, the transfer of the external MIDI data is delayed until the last data byte of the internal. MIDI data packet passes.

Indication of chord name

Figure 20A:
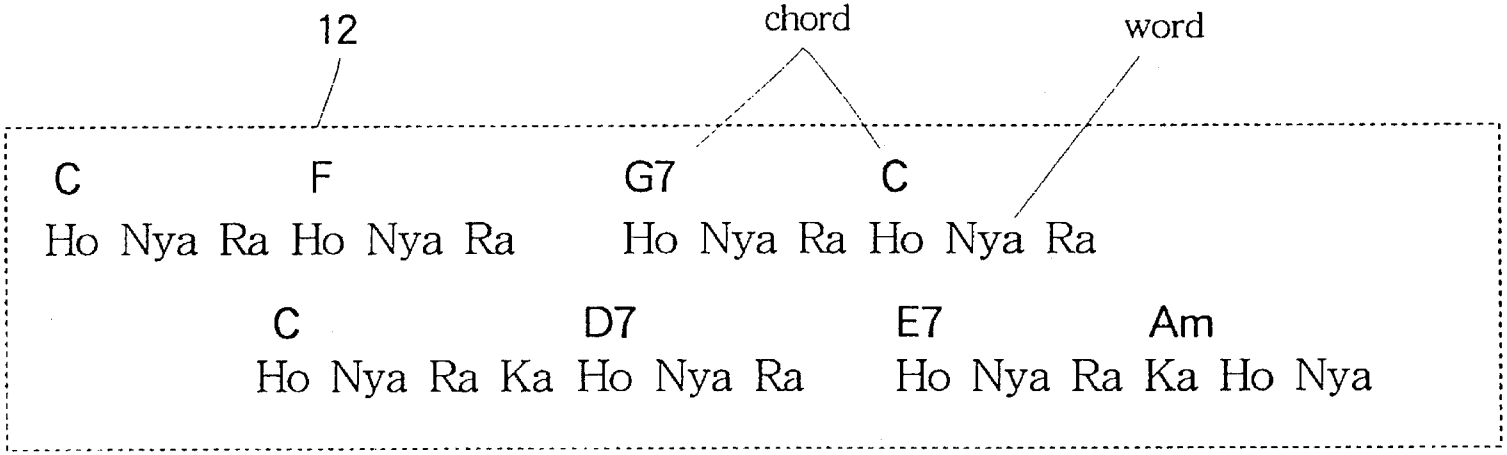
FIGS. 20A and 20B are illustrative diagrams showing display of chord names alongside word characters.
Figure 20B:
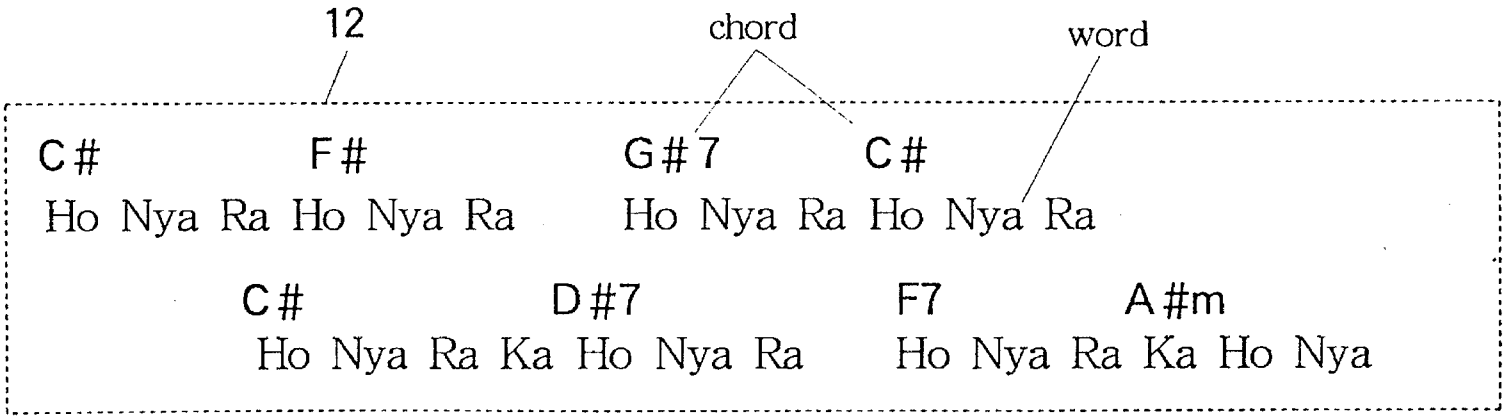

In the conventional karaoke apparatus, the monitor CRT sequentially displays the words during the course of the karaoke performance, but the monitor CRT does not indicate chord information. In the present embodiment, the monitor CRT 12 is controlled to display chord names to facilitate play of a musical instrument such as a guitar which is externally connected to the karaoke system. This chord name indication may be controlled correspondingly to the word character indication for better assist in playing. Referring to FIG. 20A, the monitor CRT 12 displays a sequence of chord names "C," "F," "G7," . . . along with the word characters "HONYARA . . . " as one example. Referring to FIG. 20B, the displayed chord names are changed to "C♯, " "F♯", "G7♯," . . . as a consequence of automatic transposition by "+1" in this example.

Hereinafter, detailed description is given for the display of the chord names. Initially, the header of the song data memorizes a standard song key (C, C♯, D♭, D, D♯, E♭, E, . . . , A♯, B♭ or B) plus a tonality indication of major/minor. This key data is used for determination of the chord names when the transposition is effected. On the other hand, the synthetic karaoke equipment utilizes the word track containing an alternate arrangement of a word event and a duration to display the song words. The word event contains various data such as a display position in terms of field coordinates x, y, an attribute, a train of characters, a display interval and a color change timing. The duration indicates a time interval between adjacent word events. The word is formed according to the train of characters, the field coordinates and the attribute (designation of color), while the color of the displayed words is changed according to the color change timing in synchronization with progression of the karaoke song performance. Then, when the display interval of one event lapses, the displayed word is erased. The word events may be prescribed continuously without interposing a duration so that a multiple of words or phrases are displayed concurrently in series.

The train of characters are defined in terms of character codes, character pitches and designation of "kana." The kana is disposed alongside Chinese characters to give the pronunciation thereof. The EUC code system is adopted in the present embodiment such that the train of characters are represented as follows. Namely, each character is coded by one-byte data or two-byte data. The one-byte data of eight bits is generally described by "0xXX" where "X" denotes a hexadecimal number 0, 1, . . . , 9, a, b, . . . , e, f. Each one-byte character is represented by codes 0x20, 0x21, . . . , 0x7e. The two-byte data is generally described by 0xXX, 0xXX where the first byte takes a value 0xa0, . . . , 0xf4 and the second byte takes a value 0xa0, . . . , 0xff. The character pitch is represented by one-byte data which takes 0x01, . . . , 0x1f. The "kana" is represented by:

0xfe/Chinese characters/0x00/kana characters/0x00.

Such a coding system of characters can be modified to represent a chord name. In this embodiment, each chord is described by three-byte data. Namely, the first byte (for example, 0xff) is used as the chord identification. The second byte is used for describing key information. Namely, the first four bits are used to denote a key such as 0/C, 1/D, 2/E, 3/F, 4/G, 5/A and 6/B. The next two bits are used to designate a symbol such as 1/♯ and 2/♭. The last one bit is used to designate a tonality such as 0/major and 1/minor. The third byte is used to denote an ornamentation such as 0/Major chord (no ornamentation), 1/7th, 2/6th, +e,fra 3+ee /Diminish, 4/sus4 and 5/7th sus4. Examples are given below:

C7=0xff, 0x00, 0x01

Am6=0xff, 0xa5, 0x02

F♯m7=0xff, 0x93, 0x01

Dsus4=0xff, 0x01, 0x04

As long as no transposition is requested, the chord name is displayed as it is according to the above described notation. However, when the transposition is requested, the chord is changed according to the following three data: the key denoted by the second byte of the original chord; a degree of the requested transposition; and the key of the song memorized in the header. For one example, in case that the memorized song key is C major and the transposition degree is "+1," the original chord G is changed to G♯. For another example, in case that the memorized song key is A minor and the transposition degree is "+1," the original chord G is changed to A♭.

Minus-one playing

In one modification, the accompaniment track of the song data may record various timbres in terms of instrument names, which are fixedly assigned to respective channels of the tone generating processor. For example, the piano sound is assigned to the first channel, the guitar sound is assigned to the second channel and so on. When the external MIDI instrument is connected to the karaoke system and a particular timbre is specified, the internal MIDI data of the same timbre is selectively blocked to silence a corresponding part of the karaoke accompaniment. By such a manner, the player of the external MIDI instrument can manually perform the silenced part in a manner so-tailed "minus-one play."

Superimposition of triple images

Figure 21:
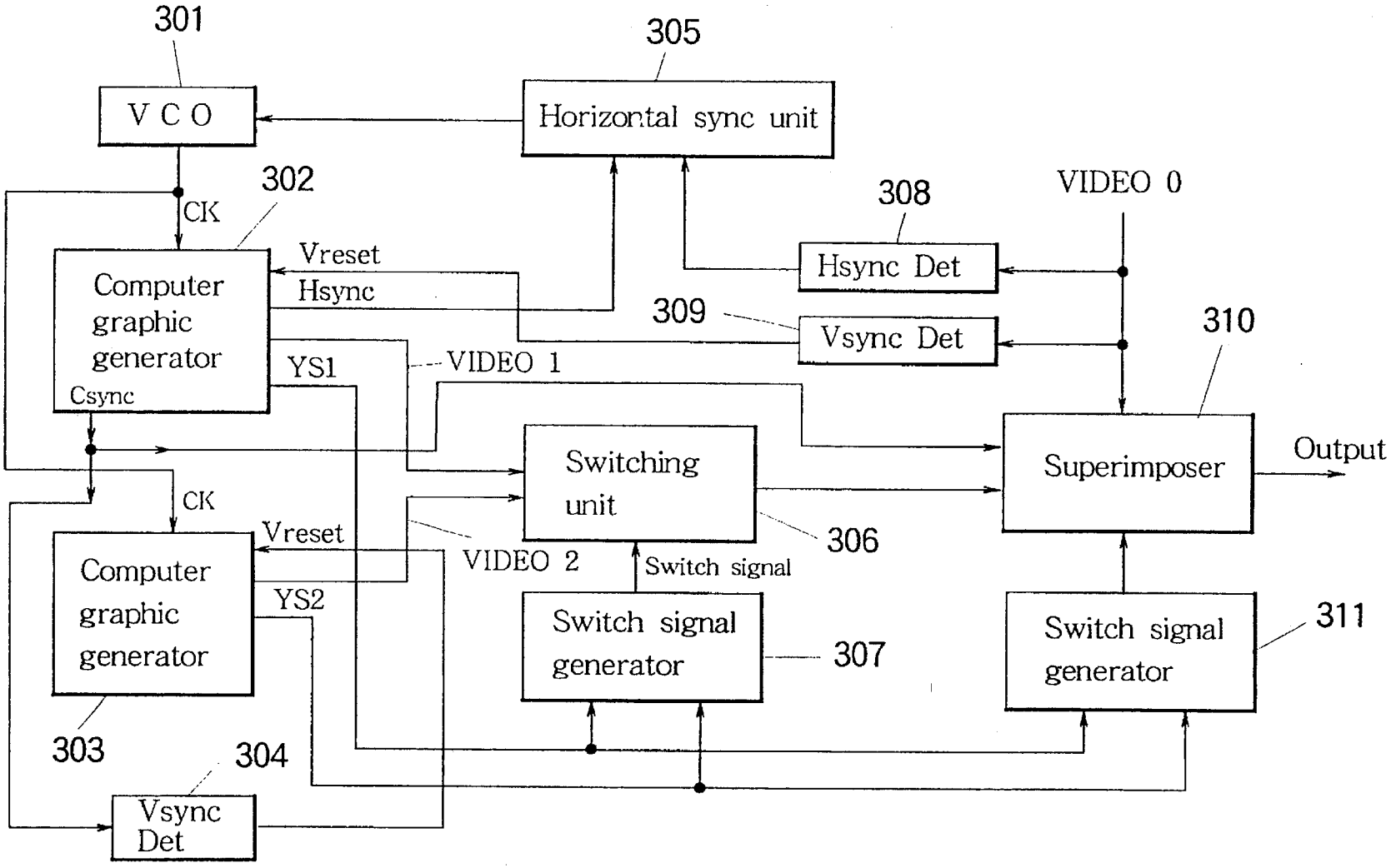
FIG. 21 is a block diagram showing a superimposing structure of triple pictures.

Three kinds of graphic images can be superimposed at most on the monitor CRT 12. Referring to FIG. 21, the LD changer 11 (FIG. 4) outputs a first external video signal VIDEO 0 representative of a background motion picture. A computer graphic generator 302 included in the video processor unit 23D1 (FIG. 4) outputs a second video signal VIDEO 1 representative of another background still picture. Another computer graphic generator 303 included in the video processor unit 23D2 (FIG. 4) outputs a third video signal VIDEO 2 representative of the song word characters. The pair of the computer graphic generators 302, 303 contain a video RAM independently from one another, and feed respective control signals YS1, YS2 effective to freely designate a transparent area over the respective image fields, so that the three images can be superimposed partly or entirely with each other to form a composite image. In the conventional karaoke apparatus, an image of the song word characters formed by computer graphics may be superimposed on another image of the background motion picture reproduced from LD. Further, an image of the song word characters formed by computer graphics may be superimposed on another image of the background still picture formed likewise by computer graphics. However, the former technique lacks a visual interest since the same background picture is applied to different karaoke songs due to capacity limitation of LD or other video record medium. The latter technique suffers from a monotonous expression even worse because the background image is composed of a still picture. On the other hand, according to the invention, three different images can be superimposed with each other at most such as the background motion picture is superimposed with a small size of the other background still picture and is further superimposed with the song word characters, thereby enhancing a variety of the graphic expression using a limited volume of the motion picture information.

Referring back to FIG. 21, a fast switching unit 306 is provided to integrate the video signals VIDEO 1 and VIDEO 2 outputted from the graphic generators 302, 303. A switch signal generator 307 generates a switch signal for controlling the switching unit 306. A superimposer 310 contained in the video selector 23E (FIG. 4) integrates the external video signal VIDEO 0 with the output from the switching unit 306. Another switch signal generator 311 generates a switch signal for controlling the superimposer 310. In this embodiment, the switching unit 306 produces the integrated form of the internal video signals VIDEO 1 and VIDEO 2 according to RGB format, while the external video signal VIDEO 0 is provided by NTSC format. These internal and external video signals must be synchronized with each other for the synthesis by the superimposer 310. For this, an external horizontal sync detector (Hsync Det) 308 detects a horizontal sync signal Hsync of the external video signal VIDEO 0. An external vertical sync detector (Vsinc Det) 309 detects a vertical sync signal Vsync of the same external video signal. An internal vertical sync detector (Vsinc Det) 304 detects a vertical sync signal Csync used in the graphic generator 302. The synchronization of the internal and external video signals is carried out by a phase locked loop (PLL) composed of a voltage controlled oscillator (VCO) 301 and a horizontal sync unit 305. The horizontal sync unit 305 is a functional block containing a PLL phase detector and a loop filter. The internal vertical and horizontal synchronization between the graphic generators 302, 303 is established by a vertical reset signal Vreset fed from the internal vertical sync detector 304 which detects the vertical sync signal Csync outputted from the graphic generator 302. This reset signal Vreset is effective to synchronize the pair of internally generated images with one another even though the external video signal is not inputted.

Data file safe

Figure 22:
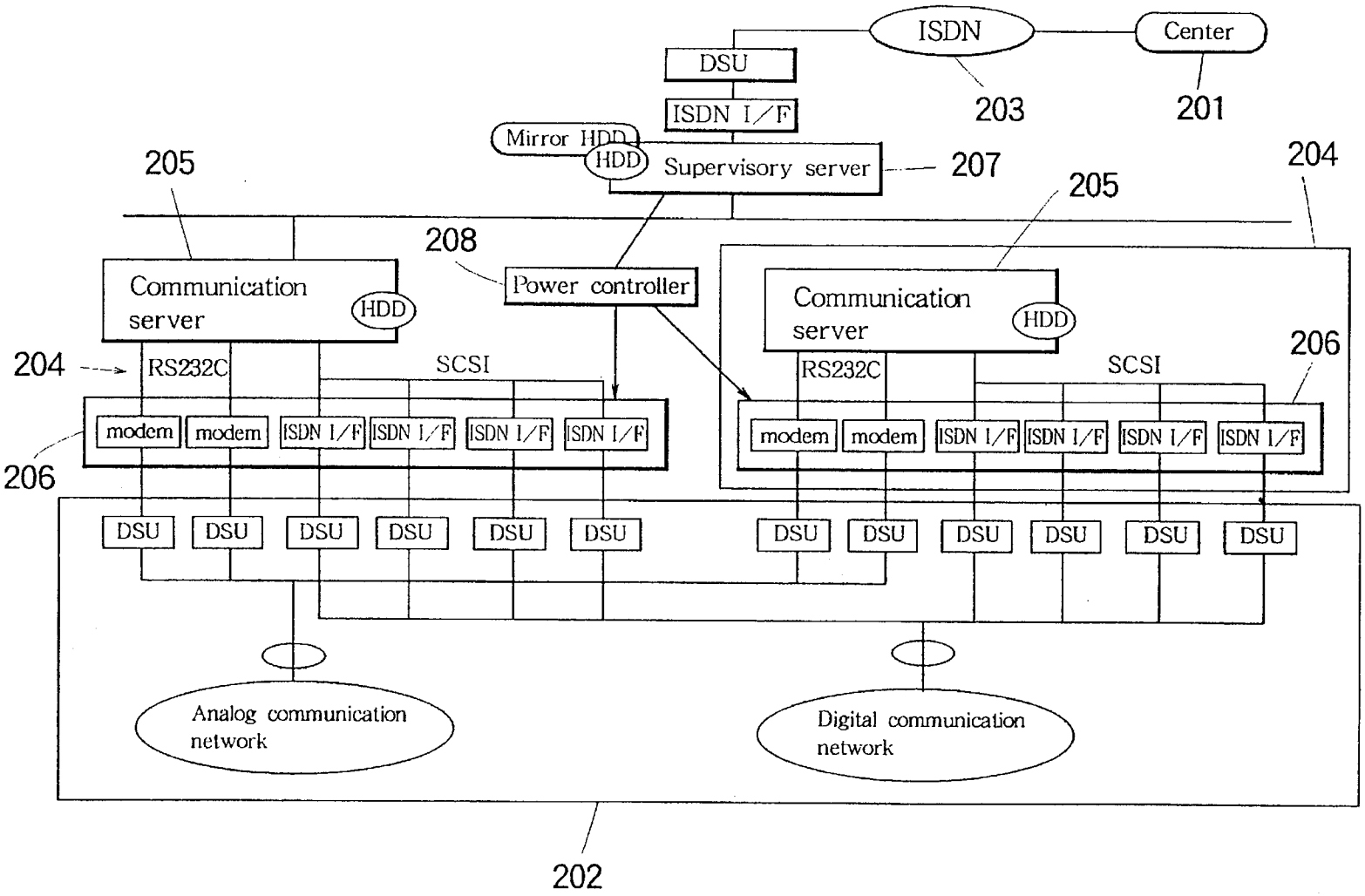
FIG. 22 is a system diagram showing a communication control installation.

The karaoke system of the musical tone synthetic type may not work well if the database function of the host station is not stably maintained, in view of lack of reliability. In order to improve the reliability of the data communication, a regular communication control unit (CCU) may be installed for multiplexing; however, such may adversely raise a system cost. Referring to FIG. 22, the present system adopts an efficient file safe structure such that a plurality of separate communication controllers 204 are interposed between an ISDN network 203 connected to a center 201 (host station) and a public network 202 connected to branches of individual karaoke systems which access to the center 201. An individual branch can access to any of the plural communication controllers 204 through the public network 202 by a key number dialing. Each communication controller 204 includes a communication server 205 composed of a work station (WS) for communication control and a terminal adapter (TA) 206, where a power supply line is provided separately for the communication server 205 and the terminal adapter 206. The terminal adapter 206 contains a digital interface (ISDN I/F) for digital network (ISDN) and a modem for an analog communication network. Each ISDN I/F is connected to the communication server 205 through SCSI line, and each modem is connected to the communication server 205 through RS232C cable. These ISDN I/F and modem is connected to the public network through a data sending unit (DSU).

A supervisory server 207 is disposed in high rank of the communication servers 204. This supervisory server 207 is composed of a work station for checking abnormality of each communication server 204 by polling or else. Upon detection of the abnormality, the supervisory server 207 enables a power controller 208 to shut down the power supply of the terminal adapter 206 involved in the defective communication server 204. Meanwhile, the power supply to a body of the defective communication server 205 is not shut down in order to avoid subsidiary affects such as clash of an HDD installed in the communication server 205. Occasionally, the terminal adapter 206 may suffer from malfunction. In such a case, the power controller 208 selectively turns off the power supply of the terminal adapter 206 in similar manner.

When the power supply is cut from a terminal adapter 206 involved in a particular communication controller 204, the user cannot transmit a message to that terminal adapter through the public communication network 202 because of no response. Practically, the key number dialing is adopted in the present embodiment such that a next line is automatically selected in the absence of response to thereby enable access to the center 201 through a normally operating communication controller 204. This method has various merits such as no specific communication control unit is required, communication lines can be increased at moderate costs, and no clash occurs in the work station because only the terminal adapter is selectively shut down. If such a measure is not adopted, when the user is incidentally connected to a terminal adapter 206 of a disabled communication controller 204 having a defective communication server 205, the user never receives a response from the defective communication server 205. As a result, the user of the karaoke system waits a long time in vain because of no response. Otherwise, the user may disconnect the line and then try another dialing. On the other hand, the inventive method can prevent such a waste of time and labor by simply turning off the power supply of the terminal adapter 206.

Portable down loader of song data

Figure 23:
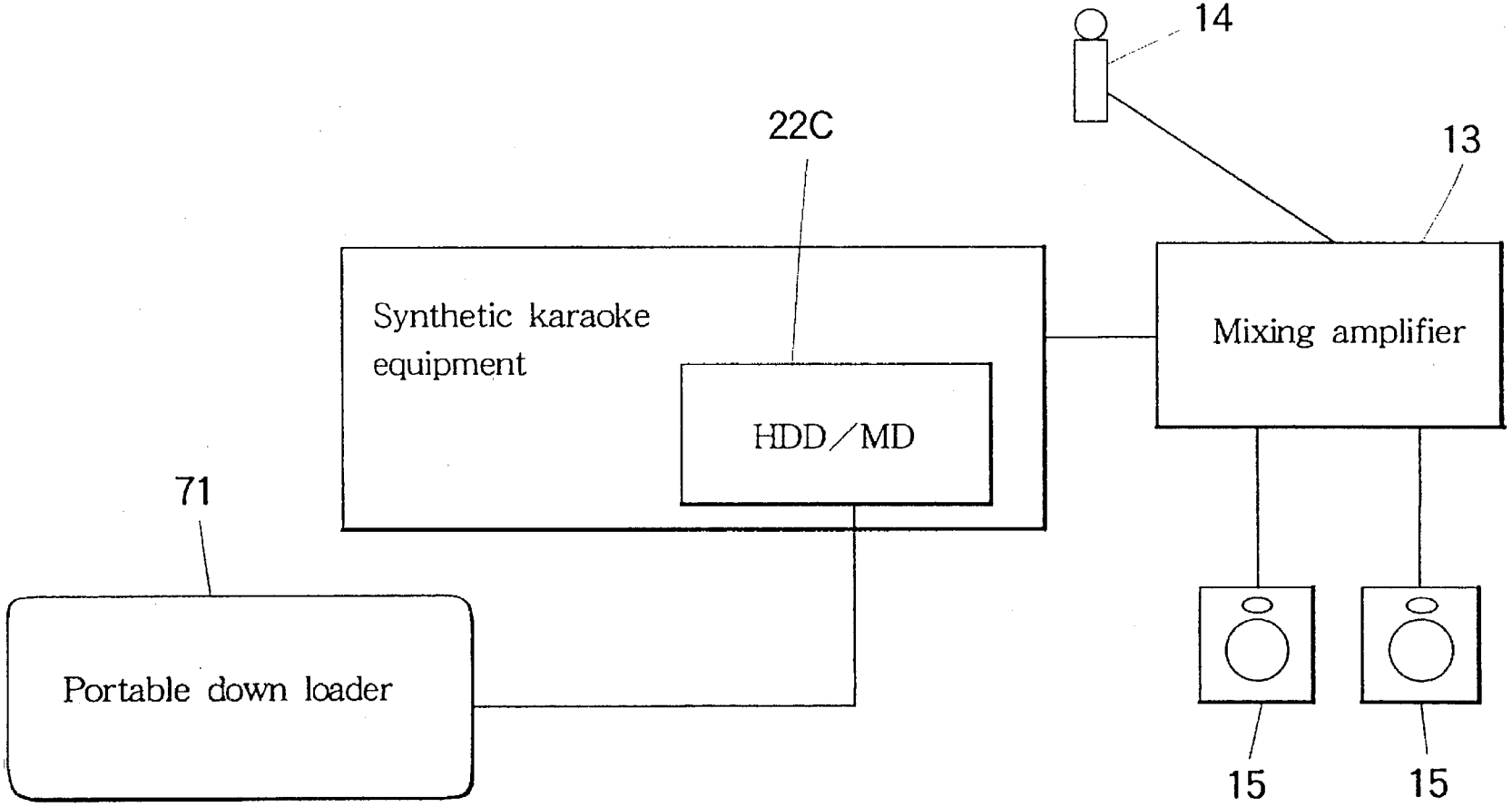
FIG. 23 is a schematic diagram showing a portable down loader in combination with an HDD storage of a synthetic karaoke equipment.

For instance, one thousand pieces of the song data in package may be down loaded at once into the HDD storage of the karaoke system shown in FIG. 4. However, the down loading of such a package of song data through the ISDN network 40 may require a high communication charge. In view of this, the portable down loader 71 is adopted to efficiently achieve the down loading of the vast volume data at lower cost in the musical tone synthetic karaoke equipment. Referring to FIG. 23, the down loader 71 is brought to a user spot where the song data stored in the down loader 71 is loaded into the storage 22C such as HDD or Mini Disc (MD) of the karaoke equipment installed in the user spot. The down loader 71 is brought to another user spot for next down loading. This down loader 71 can be utilized not only for initial loading but also periodic updating of the song data package.

Down loading to karaoke system installed in vehicle

Figure 24:
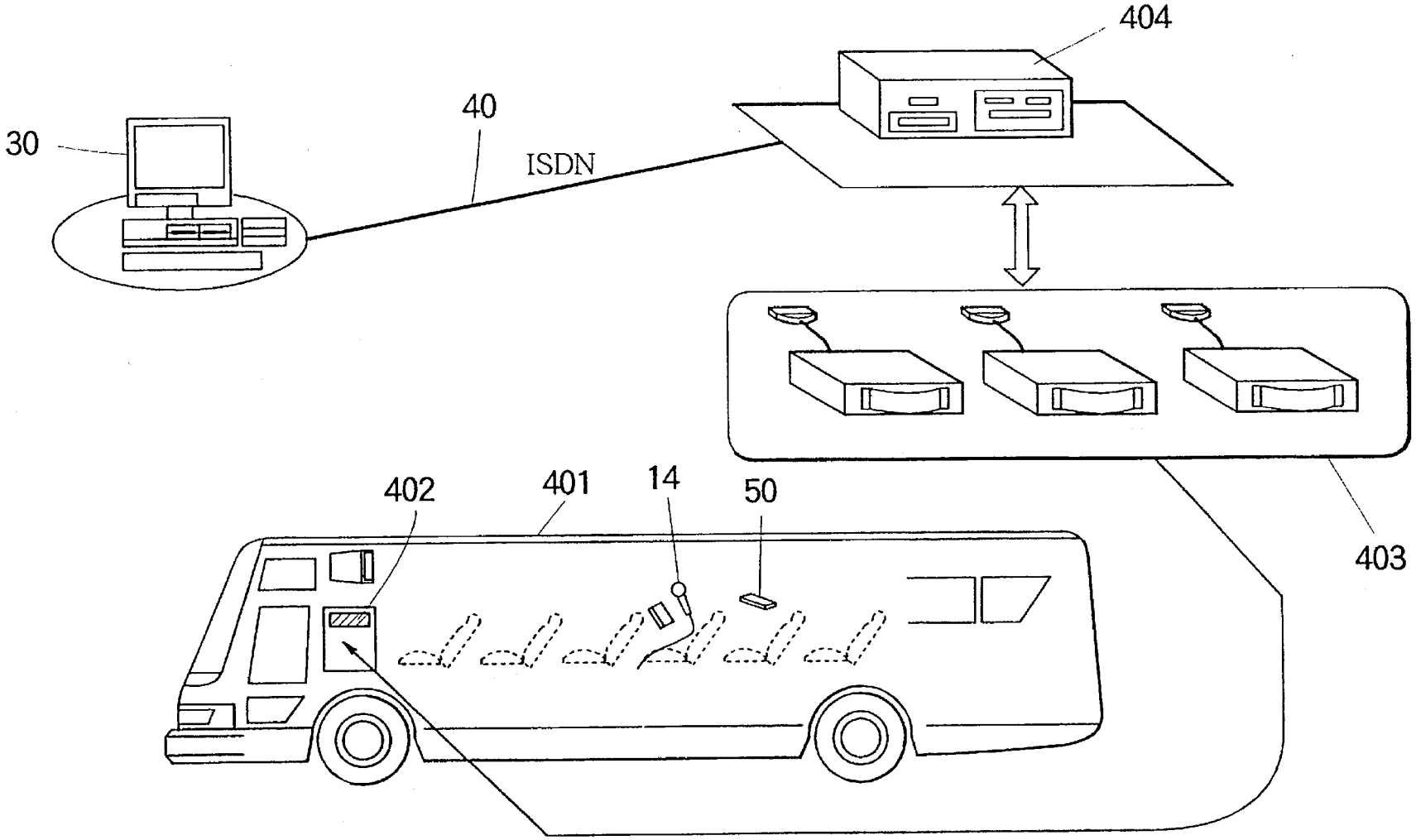
FIG. 24 is a system diagram showing down loading of song dada the karaoke system installed in a vehicle.
Figure 25:
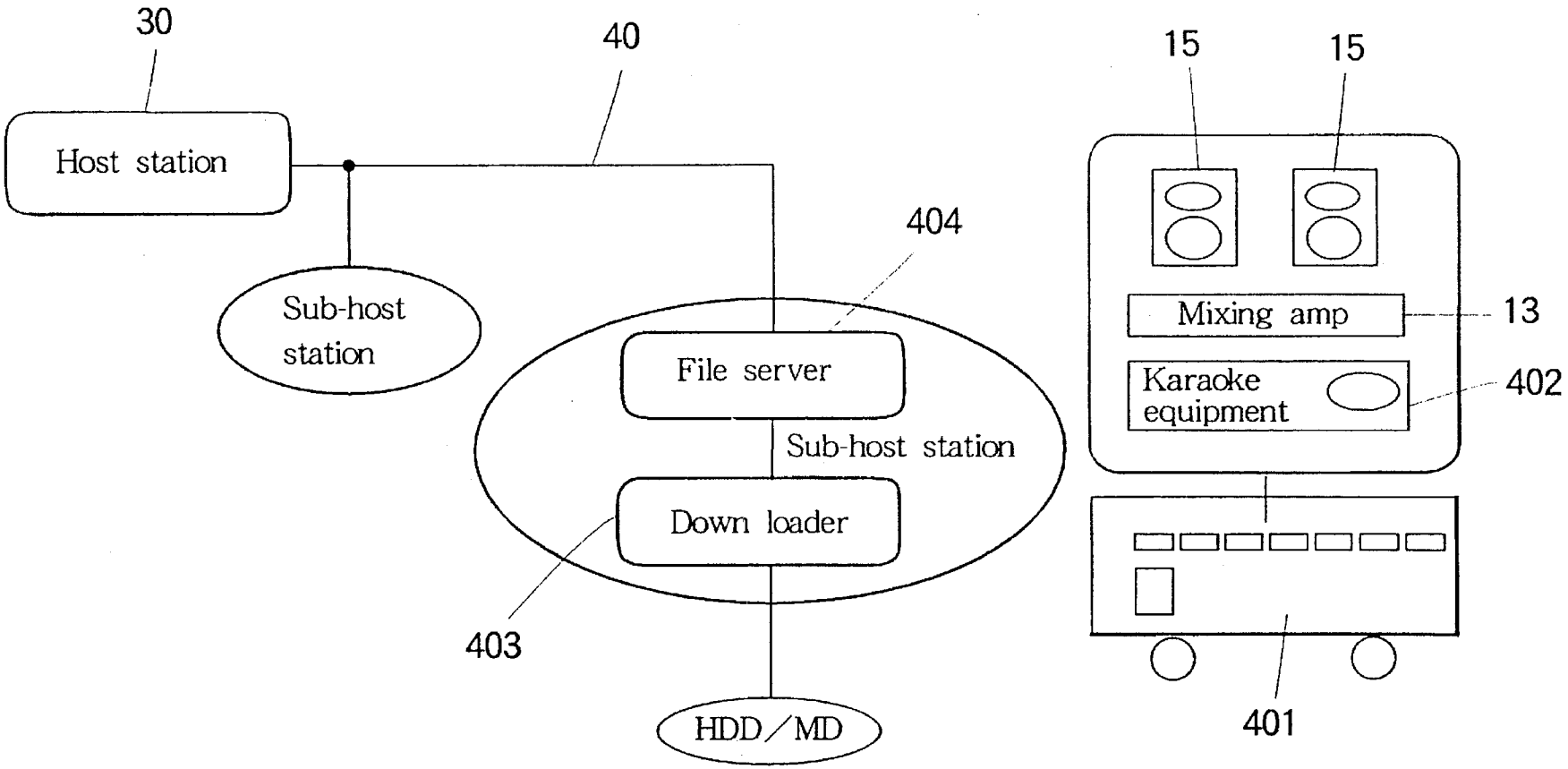
FIG. 25 is a functional block diagram of the FIG. 24 system.

The portable down loader 71 is more efficiently utilized for down loading of song data into a karaoke system installed in a vehicle which is difficult to connect to the ISDN network. Referring to FIG. 24, a karaoke equipment 402 of the sound synthetic type is mounted on a tour bus 401. A plurality of portable down loaders 403 (corresponding to the down loader 71 of FIG. 4) called "karaoke loader" are prepared for storing different packages of the karaoke song data corresponding to types of tourists such as foreigners, middle-aged persons, male tourists and female tourists. The selected down loader 403 is brought into the tour bus 401 to load an adequate package of the song data into a storage of the karaoke equipment 402. The respective down loader 403 takes from a file server 404 a package of the song data which may be updated periodically. This file server 404 is supplied with all the available song data from the host station 30 through the ISDN network 40. By such a manner, the inventive karaoke system can be installed in a vehicle which is hardly connectable to a communication network, or which suffers from a slow data transfer rate. FIG. 25 is a functional block diagram showing the data transfer in the FIG. 24 system. The file server 404 functions as a sub-host station set up in a tour bus company.

As described above, according to the invention, the sound synthetic type karaoke equipment and the playback type karaoke equipment are integrated with each other to constitute a total karaoke system. The closed data source and the open data source are selectively accessed to achieve efficient use thereof. The portable down loader is coupled to the open data source to facilitate maintenance thereof.

What is claimed is:

1. A karaoke system for sounding a karaoke song according to a request command, the request command corresponding to a karaoke song desired by a singer, the karaoke system comprising:

music playback means for pre-storing music accompaniment data as a pre-stored data source, and for reading out the pre-stored music accompaniment data to reproduce an audio signal corresponding to the music accompaniment data;

music synthesizing means for storing music performance designation data as a rewriteable data source, and for synthesizing an audio signal in accordance with the music performance designation data;

control means for receiving the request command, and for selecting either of the music playback means and the music synthesizing means according to the request command, and for controlling a selected one of the music playback means and the music synthesizing means to output an audio signal; and sound means receptive of the audio signal outputted by the selected one of the music playback means and the music synthesizing means, and for sounding a desired karaoke song corresponding to the received audio signal.

2. A karaoke system according to claim 1, wherein the music playback means has a disc record medium for pre-storing the music accompaniment data as the pre-stored data source.

3. A karaoke system according to claim 1, wherein the music synthesizing means includes means for storing the musical performance designation data in the form of song data which contains at least one of a duration of musical tones, a time length between adjacent musical tones and a tempo of a piece of music.

4. A karaoke system according to claim 1, wherein the music synthesizing means includes means for storing the musical performance designation data in the form of MIDI data.

5. A karaoke system according to claim 1, wherein the music synthesizing means further includes an external data source that is remotely accessed to supply the music performance designation data.

6. A karaoke system according to claim 5, wherein the external data source includes a remote host station having a database communicable with the control means for transmitting thereto music performance designation data in response to a request command, and storage means for stocking the transmitted music performance designation data to form a data file for re-use thereof.

7. A karaoke system according to claim 6, wherein the control means includes means responsive to a request command for issuing a first priority that is effective to select use of the pro-stored data source, a second priority that is effective to select re-use of the data file of the rewriteable data source, and a third priority that is effective to select direct use of the database of the external data source.

8. A karaoke system according to claim 6, wherein the control means includes means for preventing inadvertently designated music performance designation data from the external data source from being stocked into the storage means.

9. A karaoke system according to claim 1, including a separate loading implement for storing the music performance designation data, and being connectable to the music synthesizing means for loading thereinto the music performance designation data to fill the rewriteable data source.

10. A karaoke system including a host station and a remote branch for sounding a designated karaoke song according to a request command:

wherein the host station has an original database communicable with the remote branch to transmit thereto song data representative of a karaoke song in response to a request command; and wherein the remote branch includes storage means for stocking the transmitted song data to form a stock data file, record means independent from the database and the data file for recording a karaoke song to form a separate data source of a different data type, control means responsive to a request command for firstly accessing the separate data source, then secondly accessing the stock data file if the designated karaoke song is not found in the separate data source, and thirdly accessing the original database if the designated karaoke song is not found in the stock data file, playback means connectable to the accessed separate data source for reproducing the designated karaoke song, and synthetic karaoke means receptive of the song data from either of the accessed stock data file and the original database for processing the song data to synthesize the designated karaoke song.

11. A karaoke control apparatus for integrally controlling a playback karaoke equipment having a pre-stored data source of karaoke songs and a synthetic karaoke equipment having rewriteable data source of karaoke songs, the apparatus comprising:

playback control means for controlling the playback karaoke equipment to access the pre-stored data source to reproduce a karaoke song;

synthetic karaoke control means for controlling the synthetic karaoke equipment to access the rewriteable data source to synthesize a karaoke song; and total control means for selectively activating either of the playback and synthetic karaoke control means to select between the pre-stored and rewriteable data sources.

12. A karaoke control apparatus for integrally controlling a playback karaoke equipment having a pre-stored data source of karaoke songs, and a synthetic karaoke equipment communicable with a remote database of karaoke songs and having a data file taken from the database, the apparatus comprising:

first control means for controlling the playback karaoke equipment to access the pre-stored data source to reproduce a karaoke song:

second control means for controlling the synthetic karaoke equipment to access the data file to synthesize a karaoke song; and total control means responsive to a request command for selectively activating the first and second control means to search a desired one of the karaoke songs according to given order of priorities assigned to the first and second control means.

13. A karaoke control apparatus according to claim 12, further comprising third control means for controlling the synthetic karaoke equipment to access the database to synthesize a karaoke song such that the total control means searches for a desired one of the karaoke songs according to a given order of priorities assigned to the first, second and third control means.

14. A karaoke system for sounding a designated karaoke song according to a request command, comprising:

record means defining a pre-stored data source for readably recording a karaoke song;

playback means for reading the record means to reproduce an audio signal representative of the karaoke song such that the record means and the playback means compose a playback karaoke equipment;

supply means defining a rewriteable data source for accessibly supplying a song data prescriptive of a karaoke song;

synthetic karaoke means for processing the supplied song data to synthesize an audio signal representative of the karaoke song such that the supply means and the synthetic karaoke means compose a synthetic karaoke equipment;

total control means for selectively activating either of the playback and synthetic karaoke equipments according to a request command to select between the pre-stored and rewriteable data sources; and sound means receptive of the audio signal from the activated one of the playback and synthetic karaoke equipments to thereby readily sound a designated karaoke song.

15. A karaoke system for sounding a karaoke song according to a request command, the request command corresponding to a karaoke song desired by a singer, the karaoke system comprising:

a music playback device that pre-stores music accompaniment data as a pre-stored data source, and that reads out the pre-stored music accompaniment data to reproduce an audio signal corresponding to the music accompaniment data;

a synthetic karaoke device that stores music performance designation data as a rewriteable data source, and that synthesizes an audio signal in accordance with the music performance designation data;

a control device that receives the request command, and that selects either of the music playback device and the synthetic karaoke device according to the request command, and that controls a selected one of the music playback device and the synthetic karaoke device to output an audio signal; and a sound circuit receptive of the audio signal outputted by the selected one of the music playback device and the synthetic karaoke device, and that sounds a desired karaoke song corresponding to the received audio signal.

16. A karaoke system according to claim 15, wherein the synthetic karaoke device further includes an external data source that is remotely accessed to supply the music performance designation data.

17. A karaoke system according to claim 16, wherein the external data source includes a remote host station having a database communicable with the control device for transmitting thereto music performance designation data in response to a request command, and a storage device that stocks the transmitted music performance designation data to form a data file for re-use thereof.

18. A karaoke system according to claim 17, wherein the control means includes means responsive to a request command for issuing a first priority that is effective to select use of the pre-stored data source, a second priority that is effective to select re-use of the data file of the rewriteable data source, and a third priority that is effective to select direct use of the database of the external data source.

19. A karaoke system according to claim 17, wherein the control device includes means for preventing inadvertently designated music performance designation data from the external data source from being stocked into the storage device.

* * * * *